US008287168B2

(12) United States Patent
Taniuchi et al.

(10) Patent No.: US 8,287,168 B2
(45) Date of Patent: Oct. 16, 2012

(54) BULB-SHAPED LAMP

(75) Inventors: Akira Taniuchi, Osaka (JP); Kenji Takahashi, Osaka (JP); Nobuyuki Matsui, Osaka (JP); Tetsushi Tamura, Osaka (JP); Yasushige Tomiyoshi, Osaka (JP); Tatsumi Setomoto, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/390,320

(22) PCT Filed: Dec. 22, 2010

(86) PCT No.: PCT/JP2010/007448

§ 371 (c)(1), (2), (4) Date: Feb. 13, 2012

(87) PCT Pub. No.: WO2011/077725

PCT Pub. Date: Jun. 30, 2011

(65) Prior Publication Data

US 2012/0140480 A1 Jun. 7, 2012

(30) Foreign Application Priority Data

Dec. 22, 2009 (JP) ..... 2009-290320
Mar. 1, 2010 (JP) ..... 2010-043839

(51) Int. Cl.
*F21S 8/10* (2006.01)

(52) U.S. Cl. ..... 362/545; 362/548; 362/549; 362/647; 362/249.02

(58) Field of Classification Search ..... 313/545, 313/548, 549, 640, 647, 649, 249.02, 249.06
See application file for complete search history.

(56) References Cited

FOREIGN PATENT DOCUMENTS

| | | |
|---|---|---|
| JP | 2004-134249 | 4/2004 |
| JP | 2005-276467 | 10/2005 |
| JP | 2008-251444 | 10/2008 |

*Primary Examiner* — Vip Patel

(57) ABSTRACT

One end of a cylindrical mount 10 is attached to an end of a cylindrical base 30 that is to be inserted into a socket of a lighting fixture. The end of the mount 10 is rotatable around a central axis of a base 30. A support 40 is attached to other end of the mount 10 so as to rotate integrally with the mount 10. An LED module 51 that includes a plurality of LED chips is attached to the support 40. An end face 43*a*, on which the LED module 51 is attached, is provided on the support 40. The end face 43*a* is formed so that the direction of light emitted by the LED chips provided on the LED module 51 is inclined at a predetermined angle with respect to the axial direction of the base 30.

32 Claims, 20 Drawing Sheets

BULB-SHAPED LAMP

TECHNICAL FIELD

The present invention relates to bulb-shaped lamps, and in particular to bulb-shaped lamps using a semiconductor light-emitting device, such as a light-emitting diode (LED), as a light source.

BACKGROUND ART

Illumination apparatuses that use semiconductor light-emitting devices, such as LEDs, as a light source have been commercialized. In order to be mountable directly into existing lighting sockets for widespread incandescent bulbs, bulb-shaped LED lamps with a typical E26 base have been developed. In such a bulb-shaped LED lamp, a plurality of LED chips are generally mounted on a surface perpendicular to the central axis of the base. Light is emitted from each LED chip, which has strong directional characteristics, in the direction of the central axis of the base.

As a replacement for mini krypton bulbs, progress has also been made in the development of small bulb-shaped LED lamps with an E17 base, which is smaller than the typical E26 base. Mini krypton bulbs are often used in downlight fixtures. A small-bulb downlight fixture typically includes a socket and a hemispherical (bowl shaped) fixture body. The axis of the socket is approximately horizontal or is inclined at an angle of approximately 30° or less with respect to the horizon. The fixture body covers the mini krypton bulb whose base is mounted in the socket.

In the small-bulb downlight fixture, the hemispherical fixture body is attached to the ceiling or other surface so that an opening in the fixture body faces downwards. By being rotated through the opening of the fixture body, the base of the mini krypton bulb is mounted into the socket of the lighting fixture. Once mounted into the socket, the mini krypton bulb is maintained within the fixture body in an approximately horizontal position or inclined at an angle of approximately 30° or less with respect to the horizon.

In a conventional mini krypton bulb, since the spread angle of light is approximately 180°, centering on the light axis, light can be shone on a region below the lighting fixture when the bulb is mounted in the socket so that the axis of the socket is in a nearly horizontal state.

When a bulb-shaped LED lamp having a plurality of LED chips mounted on a surface perpendicular to the central axis of the base, as described above, is used as a replacement for a such a downlight mini krypton bulb, however, the light from the LED chips in the bulb-shaped LED lamp attached to the socket is emitted in a (forward) direction away from the base, along the central axis of the base. This leads to the risk of an insufficient amount of light being emitted towards the area of illumination below the lighting fixture.

Patent Literature 1 discloses a bulb-shaped LED lamp in which a cover housing a lighting device is attached to a base, and a spherical body provided with light-emitting diodes is attached so as to be rotatable with respect to the cover. In this bulb-shaped LED lamp, the direction of emission of light by the light-emitting diodes can be freely changed with respect to the axis of the base by rotating the spherical body with respect to the cover.

Furthermore, Patent Literature 2 discloses a bulb-shaped LED lamp in which a lighting circuit for lighting LEDs is provided inside a mount provided with a base, and LEDs are provided on the opposite side of the mount from the base with a rotating mechanism therebetween, the central light axis of the light beams emitted by the LEDs being at approximately a 90° angle with respect to the direction of insertion of the base.

CITATION LIST

Patent Literature

Patent Literature 1: Japanese Patent Application Publication No. 2008-251444

Patent Literature 2: Japanese Patent Application Publication No. 2005-276467

SUMMARY OF INVENTION

Technical Problem

In the bulb-shaped LED lamp disclosed in Patent Literature 1, since the spherical body supported by the tip of the cover is fitted inside the tip of the cover, the spherical body occupies a large volume in the cover. As a result, the lighting device for the light-emitting diode is housed inside the base provided at an edge of the cover. Greatly increasing the size of the cover to accommodate the lighting device for the light-emitting diode, however, greatly increases the overall size of the bulb-shaped LED lamp. This may make it impossible to mount the bulb-shaped LED lamp in a small-bulb downlight fixture.

Furthermore, even if the bulb-shaped LED lamp can be mounted in a small-bulb downlight fixture as a replacement for a mini krypton bulb or the like, it may not be possible to guarantee sufficient space in the lighting fixture for the spherical body. This leads to the problem of difficulty in rotating the spherical body.

On the other hand, the bulb-shaped LED lamp disclosed in Patent Literature 2 is elongated in the axial direction of the mount, since LEDs are provided at the tip of the mount extending along the axial direction, with the lighting circuit provided on the inside of the mount and the rotating mechanism located therebetween. A bulb-shaped LED lamp with this structure as well runs the risk of not being mountable in a small-bulb downlight fixture, since increasing the size of the mount in order to accommodate the lighting circuit therein greatly increases the overall size of the lamp.

In particular, in a bulb-shaped LED lamp corresponding to a small bulb, such as a mini krypton bulb, both the body and the base are small, causing the problem of a small space for the lighting circuit that provides power necessary for lighting the LED chips. If the lighting circuit is to be stored inside such a body with a reduced capacity, the electronic components forming the lighting circuit must also be reduced in size, which causes the problem of making high-power output difficult.

In order to solve the above problems, it is an object of the present invention to provide a bulb-shaped lamp that is mountable in a downlight fixture and that allows for easy adjustment of the direction of light emitted by semiconductor light-emitting devices. Another object of the present invention is to provide a bulb-shaped lamp that stably uses electronic components forming a lighting circuit. Yet another object of the present invention is to provide a bulb-shaped lamp that emits sufficient light towards an area of illumination below a lighting fixture.

Solution to Problem

In order to achieve the above object, a bulb-shaped lamp according to a first aspect of the present invention comprises a base to be inserted into a socket of a lighting fixture; a mount supported by the base so as to be rotatable around a central axis of the base; and a light-emitting module including a semiconductor light-emitting device and attached to an end or an outer surface of the mount, so that a direction of light emission from the semiconductor light-emitting device is inclined or perpendicular with respect to the central axis of the base.

In order to achieve the above object, a bulb-shaped lamp according to a second aspect of the present invention comprises a base to be inserted into a socket of a lighting fixture; a housing attached to the base; a light-emitting module including a semiconductor light-emitting device and provided in the housing so that a direction of light emission from the semiconductor light-emitting device is inclined with respect to the central axis of the base; a lighting circuit electrically connected to the light-emitting module and to the base; and a circuit substrate housed inside the housing, the lighting circuit being mounted on the circuit substrate, wherein the circuit substrate is provided along a central axis of the base, and an end portion of the circuit substrate farther from the base is located in a space within the housing on an opposite side of the light-emitting module as the direction of light emission.

In order to achieve the above object, a bulb-shaped lamp according to a third aspect of the present invention comprises a base to be inserted into a socket of a lighting fixture; a mount connected to the base so as to rotate integrally with the base; and a light-emitting module including an elongated mounting substrate and a plurality of semiconductor light-emitting devices mounted on the mounting substrate along a direction of length thereof, wherein the mounting substrate is supported by an end of the mount so as to extend away from the base along a central axis of the base.

Advantageous Effects of Invention

In the bulb-shaped lamp according to the first aspect of the present invention, the light-emitting module is attached to the mount, which is rotatably supported by the base, so that the direction of light emission is inclined or perpendicular with respect to the central axis of the base. Therefore, when the base is inserted into the socket of the lighting fixture, the direction of light emission by the semiconductor light-emitting device can be adjusted towards a predetermined direction by rotating the mount. Accordingly, the direction of light emission by the semiconductor light-emitting device can easily be adjusted after mounting in the lighting fixture.

Furthermore, since the mount is supported rotatably with respect to the base, the base and the mount can be caused to overlap, thus allowing for a reduction in overall size. As a result, the bulb-shaped lamp can be made compact enough for mounting in a small-bulb downlight fixture, allowing the bulb-shaped lamp to be used as a replacement for mini krypton bulbs.

In the bulb-shaped lamp according to the second aspect of the present invention, the circuit substrate housed inside the housing is provided along the central axis of the base and extends into the space on the opposite side of the inclined light-emitting module as the direction of light emission. Therefore, the surface area of the circuit substrate is increased. This allows for electronic components forming the lighting circuit to be mounted on the portion of the circuit substrate extending into this space, thereby accommodating large electronic components that can increase the amount of power output. Since the surface area of the circuit substrate is increased, the electronic components mounted thereon need not be crowded together, thereby suppressing an increase in temperature of the electronic components. The bulb-shaped lamp can thus be made compact while achieving high power output.

In the bulb-shaped lamp according to the third aspect of the present invention, the plurality of semiconductor light-emitting devices in the light-emitting module attached to the mount are provided along the central axis of the base, allowing for illumination of a wide region below the lighting fixture.

DESCRIPTION OF EMBODIMENTS

As Embodiment 1 of a bulb-shaped lamp according to the present invention, with reference to the drawings the following describes a bulb-shaped LED lamp having semiconductor light-emitting devices, i.e. LED chips.

Embodiment 1

Figure 1:
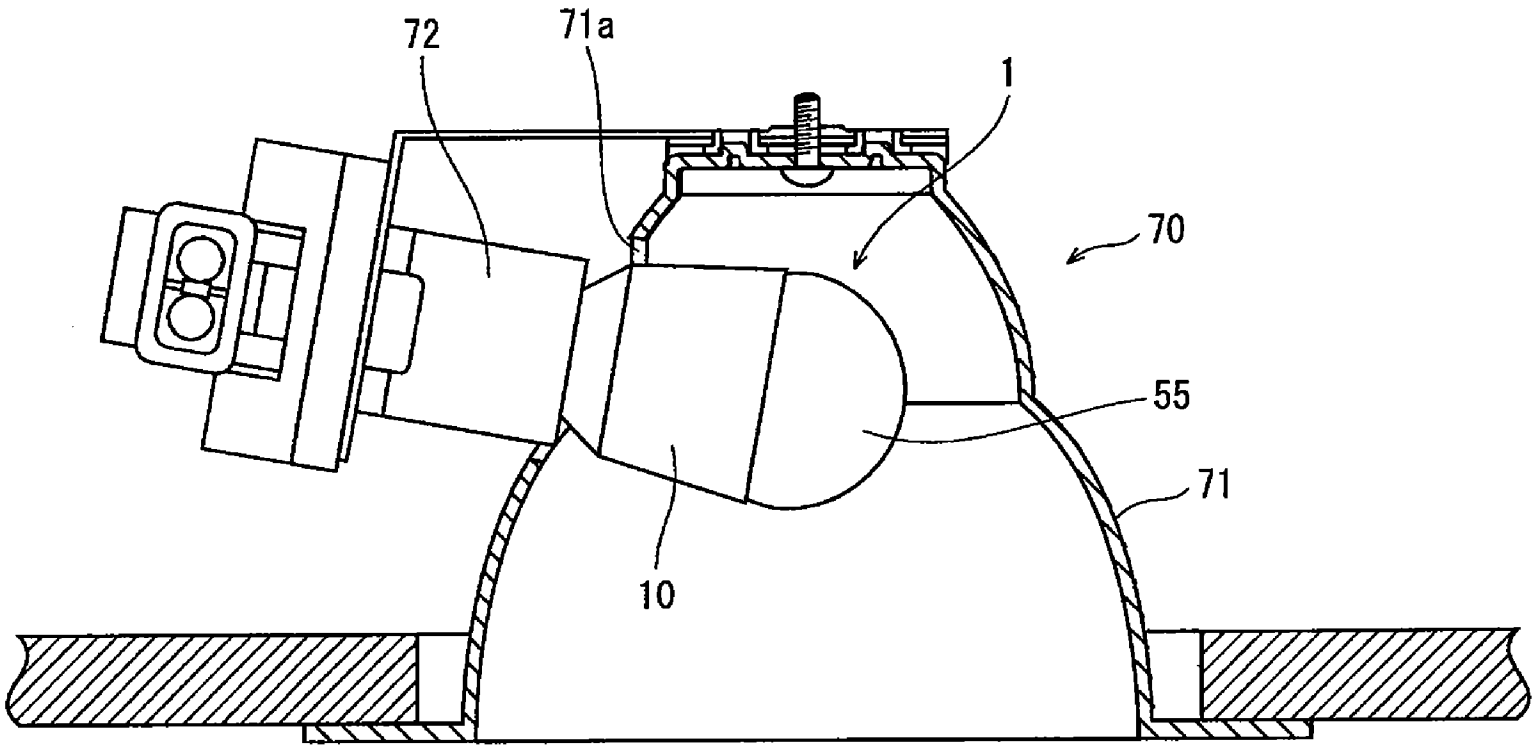
FIG. 1 is a cross-section diagram of a lighting fixture for a typical incandescent light bulb into which a bulb-shaped LED lamp according to Embodiment 1 of the present invention has been mounted.

FIG. 1 is a cross-section diagram of a lighting fixture for a typical incandescent light bulb into which a bulb-shaped LED lamp 1 according to Embodiment 1 has been mounted. A lighting fixture 70 includes a hemispherical (bowl shaped) fixture body 71 attached to the ceiling and a socket 72 attached to the fixture body 71. The socket 72 is supported externally to the fixture body 71 with an insertion opening, into which the base of a typical incandescent bulb is inserted, facing an opening 71*b* formed on the peripheral surface of the fixture body 71. The socket 72 is slightly inclined with respect to the horizon so that the insertion opening is tilted downwards.

Figure 2:
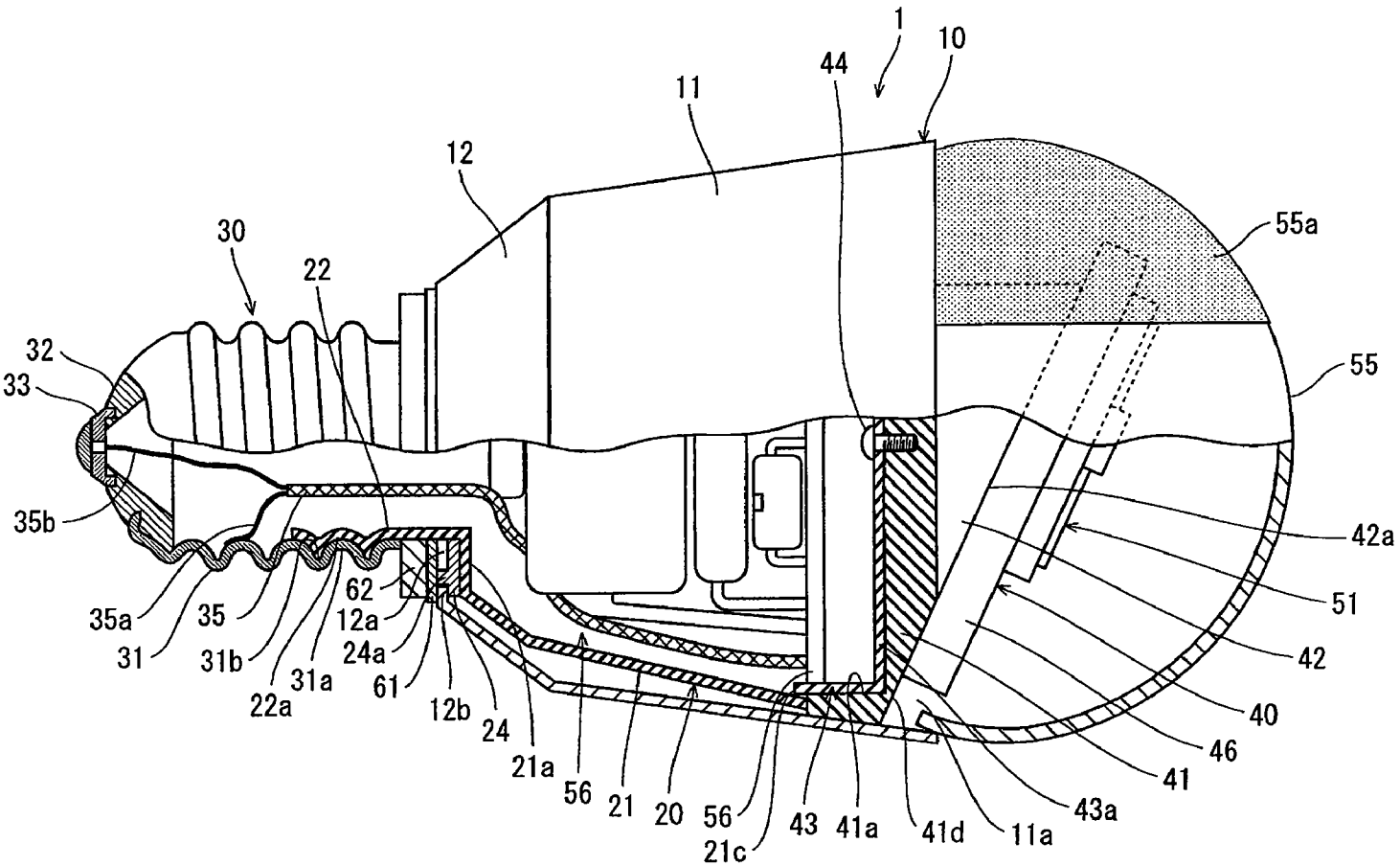
FIG. 2 is a partially broken side view showing the structure of the bulb-shaped LED lamp.
Figure 3:
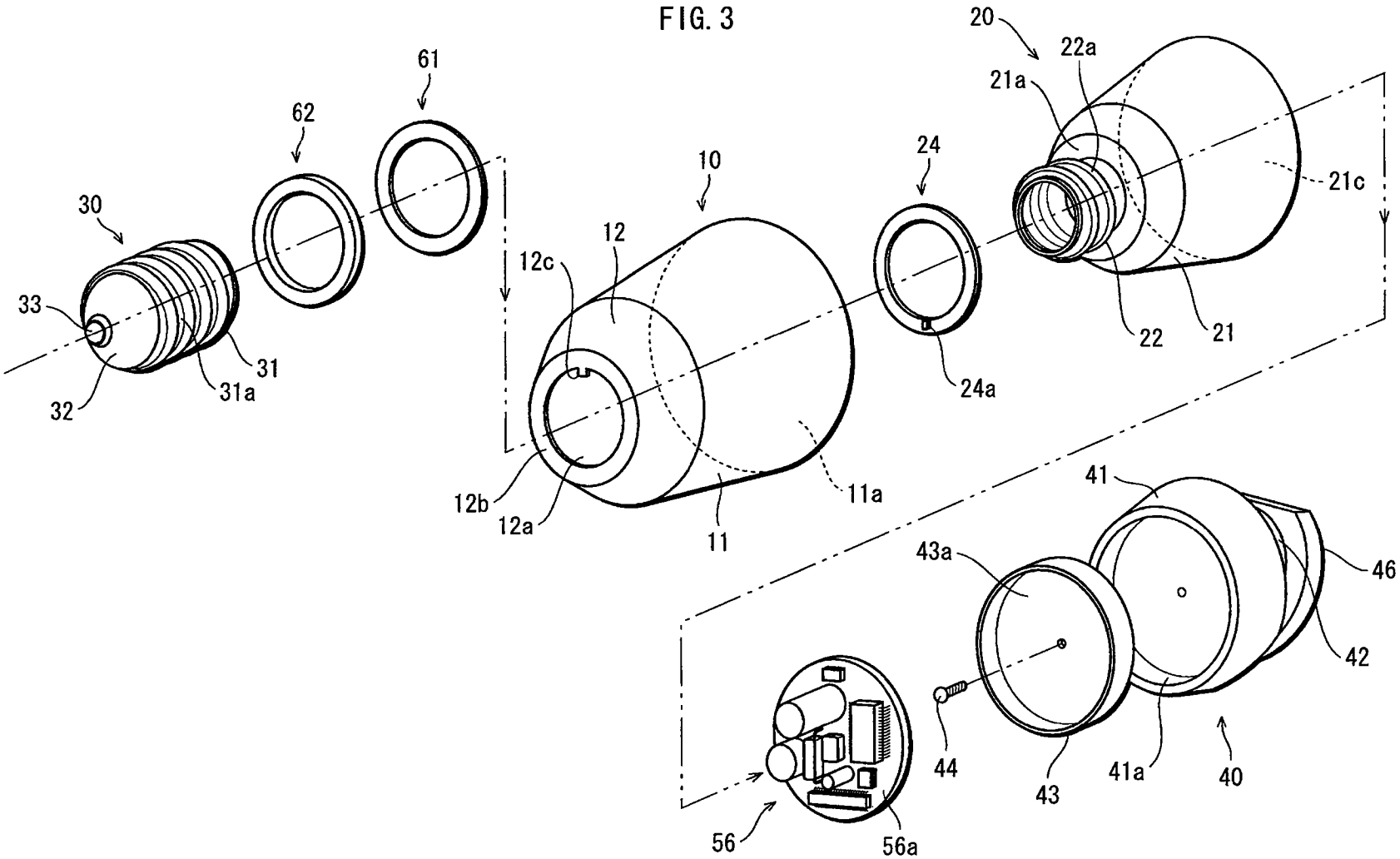
FIG. 3 is an exploded perspective view of the bulb-shaped LED lamp.

FIG. 2 is a partially broken side view showing the structure of the bulb-shaped LED lamp 1 in the present embodiment. FIG. 3 is an exploded perspective view showing the main components of the bulb-shaped LED lamp.

The bulb-shaped LED lamp in the present embodiment includes a cylindrical mount (housing) 10 with a circular cross-section, a support 40 that supports an LED module 51 and is integrally rotatable with the mount 10, a circuit unit case 20 that is partially housed in the mount 10, a lighting circuit unit 56 that lights the LED module 51 and is enclosed in the circuit unit case 20, a base 30 in the shape of a circular cylinder connected integrally to the circuit unit case 20, and a globe 55 attached to the mount 10 so as to cover the LED module 51. Note that the globe 55 is omitted in FIG. 3.

So that the base 30 can be mounted in the socket 72 of the lighting fixture 70, the base 30 for example complies with the standards for an E17 base as specified by the Japanese Industrial Standards (JIS). The base 30 is attached to a connector 22 that is in the shape of a circular cylinder and is provided at one end of the circuit unit case 20.

Note that the base 30 is not limited in this way to a structure complying with the standards for an E17 base. The base 30 may have a structure complying with other JIS standards (such as for an E26 base) in order to be mountable in sockets of other lighting fixtures.

The base 30 has a shell 31 in the shape of a circular cylinder. As shown in FIG. 2, along the outer circumferential surface of the shell 31, a screw groove 31*a* is provided for mounting the shell 31 inside the socket 72 in the lighting fixture 70. A screw groove 31*b* is also provided along the inner circumferential surface of the shell 31 for connecting with the connector 22 provided at one end of the circuit unit case 20.

An insulating connector 32 is provided in the shell 31 at the end thereof that is inserted into the socket 72. The insulating connector 32 is in the shape of a hollow cone protruding towards the insertion end of the shell 31 and is attached coaxially with the shell 31. An eyelet 33 is attached to the tip of the insulating connector 32. The shell 31 and the eyelet 33 are integrally connected by the insulating connector 32.

Twisted wires (electrical wiring) 35 that include a first electric supply line 35*a* and a second electric supply line 35*b* for providing power to the lighting circuit unit 56 housed in the circuit unit case 20 are provided inside the base 30. One end of the first electric supply line 35*a* is connected to the shell 31, and one end of the second electric supply line 35*b* is connected to the eyelet 33. The twisted wires 35 traverse the inside of the shell 31.

The circuit unit case 20 includes a cylindrical case body 21 having a circular cross-section and a case bottom 21*a* located at one end of the case body 21. The connector 22, which is in the shape of a circular cylinder, is provided at the case bottom 21*a* for connection with the base 30 by insertion into the shell 31 of the base 30. The diameter of the case body 21 increases with distance from the case bottom 21*a*. An end face of the case body 21 located at the opposite side of the case bottom 21*a* is a case opening 21*c*, which extends across the entire end face (see FIG. 3).

The circular cylinder connector 22 is provided coaxially with the case body 21 and protrudes from the central region of the case bottom 21*a*, in a direction away from the case body 21, approximately ½ the length of the shell 31 measured the direction of the axis thereof. The inside of the connector 22 is in communication with the inside of the case body 21. The case body 21 and the connector 22 are integrally molded with an insulating synthetic resin.

A screw groove 22*a* is provided on the inner circumferential surface of the connector 22. When the connector 22 is inserted inside the shell 31, the screw groove 22*a* is threaded into the screw groove 31*b* provided along the inner circumferential surface of the shell 31. The connector 22 and the base 30 are thus connected.

The twisted wires 35, which includes the first electric supply line 35*a* and the second electric supply line 35*b* that are respectively connected to the shell 31 and the eyelet 33 of the base 30, traverse the inside of the connector 22 connected to the shell 31 to reach the inside of the case body 21. The twisted wires 35 further traverse the inside of the case body 21 to arrive near the case opening 21*c*.

The case body 21 of the circuit unit case 20 is housed inside the cylindrical mount 10. A mount bottom surface 12*b* is provided at one end face of the mount 10 and includes a through-hole 12*a* through which the connector 22 of the circuit unit case 20 protrudes.

An outline of the mount 10 resembles the bottom side of the body of a typical incandescent bulb, including a mount bottom section 12 and a mount body 11. The mount bottom section 12 is in the shape of a circular cylinder and is continuous with the mount bottom surface 12*b*. The mount body 11 is in the shape of a circular cylinder, is concentric with the mount bottom section 12, and is continuous with the mount bottom section 12 in a direction away from the mount bottom surface 12*b*.

The diameter of the mount bottom section 12 increases progressively with distance from the mount bottom surface 12*b*. The diameter of the mount body 11 also increases progressively with distance from the mount bottom section 12, but the circumferential surface of the mount body 11 is inclined at a smaller inclination angle than the circumferential surface of the mount bottom section 12. The end face of the mount body 11 at the opposite end from the mount bottom section 12 is a mount opening 11*a* that extends across the entire end face.

The through-hole 12*a* formed on the mount bottom surface 12*b* of the mount bottom section 12 is a circle with a diameter slightly larger than the outer diameter of the connector 22 and is centered on the central axis of the mount bottom section 12. The through-hole 12*a* is surrounded by the mount bottom surface 12*b*. The mount bottom surface 12*b* is a flat surface perpendicular to the central axis of the mount bottom section 12 and faces the case bottom 21*a* when the connector 22 of the circuit unit case 20 is inserted through the through-hole 12*a*.

At one circumferential location of the mount bottom surface 12*b*, an engaging portion 12*c* (see FIG. 3) protrudes inwards (towards the central axis of the mount bottom section 12).

The mount 10 is formed integrally by aluminum die casting and has a constant thickness throughout of approximately 1.5 mm to 3 mm.

Over the entire outer circumferential surface of the mount 10, an alumite layer (anodic oxide coating) is formed, for example, to a thickness of 10 μm by alumite treatment, thereby improving heat dissipation characteristics.

For example, the thermal emissivity at the surface of an alumite layer (the surface of a white alumite coating) formed on the outer circumferential surface of the mount 10 by white alumite treatment is 0.8. In this case, the thermal emissivity of the inner circumferential surface of the mount 10, to which alumite treatment has not been applied, is 0.05. The thermal emissivity of the outer circumferential surface is thus over ten times higher than the thermal emissivity of the inner circumferential surface.

A portion of the heat that is transferred to the mount 10 radiates from the surface of the mount 10. In this case, since the thermal emissivity of the outer circumferential surface is greater than that of the inner circumferential surface of the mount 10, radiation of heat along the outer circumferential surface is promoted, whereas radiation of heat along the inner circumferential surface is suppressed. As a result, radiation of heat from inside the mount 10 to the outside is promoted, so that the amount of heat remaining within the mount 10 is reduced.

Note that the alumite layer is not limited to a white alumite coating but may also be a black alumite coating.

Since the alumite layer (alumite coating) formed by alumite treatment is thin, the alumite layer has almost no effect on the volume and weight of the mount 10. Accordingly, forming the alumite layer achieves high heat dissipation characteristics without impeding a reduction in size and weight of the mount 10.

Instead of forming an alumite layer on the outer circumferential surface of the mount 10 by alumite treatment, heat dissipation characteristics may also be improved by applying synthetic resin to the outer circumferential surface of the mount 10.

A stopper ring 24 is attached to the case bottom 21*a*, where the connector 22 in the case body 21 is provided. The stopper ring 24 is a restricting member that restricts the range of rotation of the mount bottom surface 12*b* of the mount bottom section 12 to be less than one full rotation of 360°. The stopper ring 24 is a metal plate, such as stainless steel, in the shape of a ring. The stopper ring 24 is concentric with the connector 22 and is attached to the case bottom 21*a* by, for example, adhesive.

A washer 61 and an insulating ring 62 are engaged, in this order from the mount bottom surface 12*b*, with the connector 22 of the circuit unit case 20. The connector protrudes through the through-hole 12*a* of the mount bottom surface 12*b* in the mount 10. The base 30 attached to the connector 22 presses on the washer 61 via the insulating ring 62 so that the washer 61 presses against the mount bottom surface 12*b*.

At one circumferential location of the stopper ring 24, a stopper 24*a* is provided as an engaging portion projecting in the direction of projection of the connector 22. The stopper 24*a* is in close contact with the inner perimeter of the mount bottom surface 12*b* when inserted through the through-hole 12*a* of the mount bottom surface 12*b*.

When the base 30 has been attached to the connector 22, the compressive force (tightening force) from the base 30 acts on the mount bottom surface 12*b* via the insulating ring 62 and the washer 61, and the mount bottom surface 12*b* is pressed against the stopper ring 24 attached to the case bottom 21*a*. In this state, the mount bottom surface 12*b* is sandwiched between the stopper ring 24 and the washer 61 so as to be fixed with respect to the connector 22. The mount 10 is therefore fixed with respect to the circuit unit case 20.

If the mount 10 is rotated so that a force applied to the mount bottom surface 12*b* is larger than the friction between the mount bottom surface 12*b* and each of the stopper ring 24 and the washer 61, the mount bottom surface 12*b* rotates around the connector 22 while being pressed against the stopper ring 24 and the washer 61.

As a result, the entire mount 10 rotates with respect to the circuit unit case 20. Since the stopper 24*a* inserted into the through-hole 12*a* is in close contact with the inner perimeter of the mount bottom surface 12*b*, when the entire mount 10 rotates with respect to the circuit unit case 20, the stopper 24*a* rotates along the inner perimeter of the mount bottom surface 12*b* and comes into contact with the engaging portion 12*c* that protrudes inwards from the inner perimeter of the mount bottom surface 12*b*. Rotation of the mount 10 is restricted by the engaging portion 12*c* coming into contact with the stopper 24*a*.

The engaging portion 12*c* and the stopper ring 24 with the stopper 24*a* thus form a restricting member that restricts rotation by the mount 10 with respect to the circuit unit case 20.

Within the mount 10, at the end of the mount body 11 by the mount opening 11*a*, a support 40 is integrally mounted to support the LED module 51 in a predetermined position.

Figure 4:
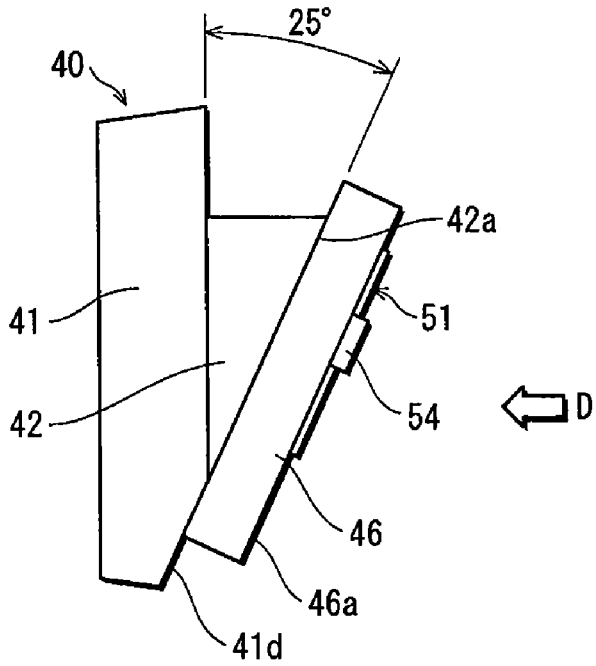
FIG. 4 is a lateral view of a support to which an LED module is attached.

FIG. 4 is a lateral view of the support 40. The support 40 includes a support body 41 and a support base 42. The outer circumferential surface of the support body 41 is inclined in the same way as the tip of the mount body 11 so that the support 40 presses against the inner circumferential surface of the mount body 11. The support base 42 is provided in the support body 41 at the opposite side from the case body 21. The support body 41 and the support base 42 of the support 40 are, for example, integrally formed from aluminum.

The support body 41 is inserted through the mount opening 11*a*, and the outer circumferential surface of the support body 41 presses against the inner circumferential surface of the mount body 11 at a location near the mount opening 11*a*. The support 40 is thereby integrally assembled with the mount body 11. As a result, in this state, the support 40 rotates integrally with the mount 10 when the mount 10 is rotated with respect to the circuit unit case 20.

A concavity 41*a* is provided in a portion of the support body 41 by the circuit unit case 20. The concavity 41*a* is a circular cylinder opening towards the case body 21. A cap member 43 in the shape of a circular cylinder engages with the concavity 41*a*. The cap member 43 is closed off by an end face 43*a* located by the innermost side of the concavity 41*a*. The end face 43*a* is attached to the support body 41 by a screw 44 provided at the axial center of the end face 43*a*. The opposite side of the cap member 43 from the end face 43*a* protrudes outwards beyond the concavity 41*a* and engages with the tip of the case body 21. The cap member 43 is formed from similar insulating synthetic resin as the case body 21.

The cap member 43 houses a circuit substrate 56*a* for the lighting circuit unit 56 that is housed inside the case body 21. The circuit substrate 56*a* is in the shape of a circular plate. The circuit substrate 56*a* is retained perpendicular to the central axis of the case body 21 by a retaining member, not shown in the figures, at an appropriate distance from the end face 43*a*.

A plurality of electronic components (such as a rectifying/smoothing circuit, a DC/DC converter, and the like) are mounted on a surface of the circuit substrate 56*a* facing the inside of the case body 21. The electronic components convert commercial 100 V AC power provided via the base 30 into DC power of a predetermined voltage. The DC power converted by the lighting circuit unit 56 is provided to the LED module 51 attached to the support 40.

The twisted wires 35 connected to the base 30 traverse the inside of the case body 21 to reach the circuit substrate 56*a* in the lighting circuit unit 56. The first electric supply line 35*a* and the second electric supply line 35*b* of the twisted wires 35 are connected to the electronic components mounted on the circuit substrate 56*a*. The twisted wires 35 are bent within the case body 21 in order to rotate with the circuit substrate 56*a* when the circuit substrate 56*a* rotates 360° around a central axis with respect to the case body 21.

The support base 42, provided at the opposite side of the support body 41 from the case body 21, is smaller in diameter than the support body 41. The support base 42 is in the shape of a cylinder that is coaxial with the support body 41 and is partially cut away so that an end face 42*a* at the opposite side from the support body 41 is inclined with respect to the central axis. The end face 42*a* of the support base 42 is a surface inclined at an angle of, for example, approximately 25° with respect to a line perpendicular to the central axis of the circuit unit case 20.

On the support body 41, which is located by the case body 21, an inclined surface 41*d* is provided. The inclined surface 41*d* is continuous with the end face 42*a* of the support base 42, so that a portion of the cylindrical support body 41 is cut away at an edge thereof by the support base 42.

An insulating support substrate 46 is provided on the end face 42*a* of the support base 42. The LED module 51 is attached to the support substrate 46.

Figure 5:
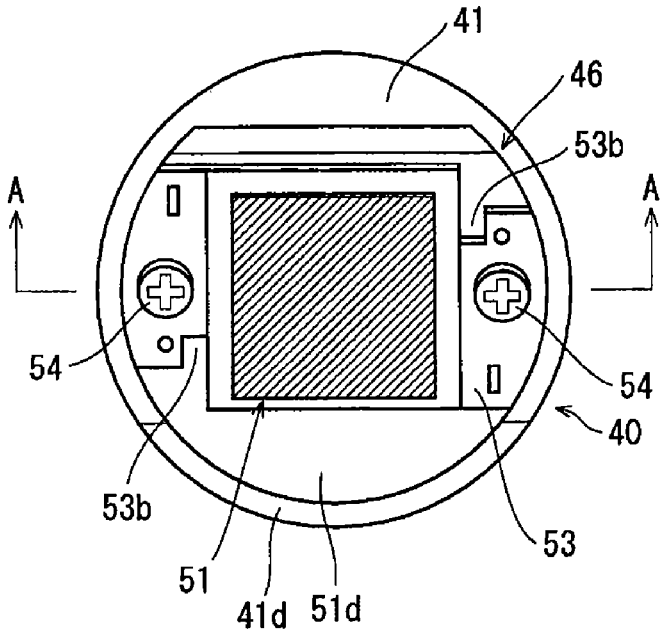
FIG. 5 is a front view in the direction of the arrow D in FIG. 4.

FIG. 5 is a front view in the direction of the arrow D in FIG. 4. The support substrate 46 is in the shape of a circular disc of constant thickness with a portion thereof cut out to form an arc. The support substrate 46 has a diameter slightly larger than the diameter of the inclined end face 42*a* of the support base 42 and is concentric with the end face 42*a*. A portion of the support substrate 46 is mounted on the inclined surface 41*d* of the support body 41.

Figure 6:
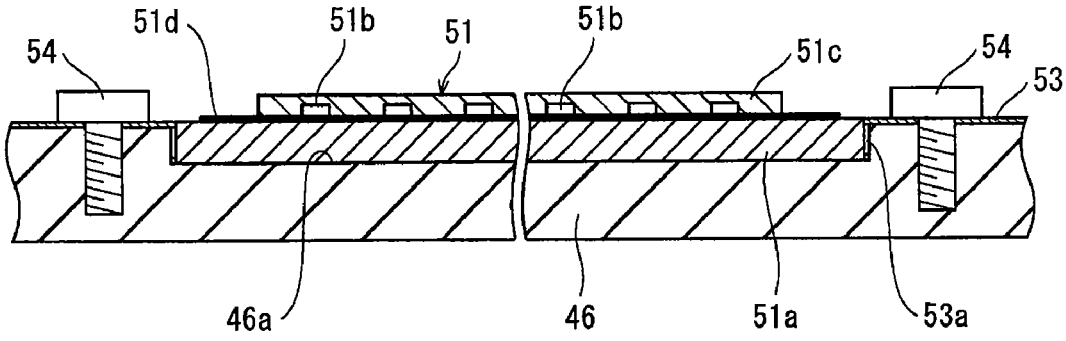
FIG. 6 is a cross-section view of the line A-A in FIG. 5.

FIG. 6 is an expanded cross-section view of the line A-A in FIG. 5. The LED module 51 attached to the support substrate 46 includes a rectangular, flat mounting substrate 51*a*, a plurality of LED chips 51*b* mounted on the mounting substrate 51*a*, and a phosphor-containing resin 51*c* that seals all of the LED chips 51*b*.

The mounting substrate 51*a* of the LED module 51 engages with a concavity 46*a* provided in the support substrate 46. A pair of thin disc-shaped fixing members 53 is attached by screws 54 to the support substrate 46 in order to fix the mounting substrate 51*a* that is engaged with the concavity 46*a*. The fixing members 53 are provided along the surface of the support substrate 46 so as to surround the concavity 46*a*. The fixing members 53 include a pair of fixing parts 53*a* that are bent so as to be inserted between the concavity 46*a* and the mounting substrate 51*a* engaged with the concavity 46*a*. The fixing parts 53*a* are provided across the concavity 46*a* from each other and fix the mounting substrate 51*a* within the concavity 46*a*.

The mounting substrate 51*a* of the LED module 51 is a constant thickness, and like the support substrate 46, is inclined similarly to the inclined end face 42*a* of the support 40. The plurality of LED chips 51*b* mounted on the mounting substrate 51*a* are centered on a position of the mounting substrate 51*a* that intersects the central axis of the mount 10. Each LED chip 51*b* emits light along a central axis (light axis) that is perpendicular to the light-emitting surface. The light axis of each LED chip 51*b* is thus inclined at an angle of 25° with respect to the central axis of the mount 10. Accordingly, the light axis of each of the LED chips 51*b* is parallel to a line that is inclined at an angle of 25° with respect to the central axis of the mount 10 and that traverses the central position of the mounting substrate 51*a* that intersects the central axis of the mount 10.

A pair of wiring patterns 51*d* connected to all of the LED chips 51*b* is provided on the mounting substrate 51*a* of the LED module 51. Each of a pair of power lines (not shown in the figures) is connected to the corresponding wiring pattern 51*d* for supplying power from the lighting circuit unit 56 to the LED chips 51*b*. The pair of power lines traverses a cut-out section 53*b* (see FIG. 5) provided in each opposing corner of the fixing members 53 and connects to the wiring patterns 51*d*. The pair of power lines traverses the support substrate 46, the support base 42 of the support 40, and the support body 41 of the support 40 in this order so as to supply power from the electronic components provided on the circuit substrate 56*a* of the lighting circuit unit 56.

The globe 55 covering the LED module 51 is attached to the tip of the mount 10 that forms the periphery of the mount opening 11*a*. The globe 55 is an open-ended hemisphere formed with a light transmissive material such as glass or synthetic resin. The perimeter of the open end of the globe 55 is supported in engagement with the mount opening 11*a* of the mount 10.

A reflective film 55*a* (see FIG. 2), formed for example from aluminum, is provided along the inner circumferential surface of the globe 55 so as to cover the edge of the support substrate 46 that is located at a distance from the support body 41. The reflective film 55*a* covers a portion of the globe 55 and reflects light from the LED module 51 mounted on the support substrate 46, so that the emission direction of the reflected light nearly matches the direction of light emitted directly by the LED module 51.

The reflective film 55*a* is formed by, for example, deposition of aluminum on the inner circumferential surface of the globe 55. Note that the reflective film 55*a* is not limited to aluminum and may be formed from another metal such as gold (Au), silver (Ag), or the like. Furthermore, formation of the reflective film 55*a* is not limited to deposition on the inner circumferential surface of the globe 55, but may instead be formed another method such as adhesion of a reflective film to the inner circumferential surface of the globe 55.

In the bulb-shaped LED lamp 1 with the above structure, the mount 10 is rotatable with respect to the circuit unit case 20. When the mount 10 is rotated, the engaging portion 12*c* provided in the mount bottom surface 12*b* of the mount bottom section 12 rotates along the inner circumferential surface of the stopper ring 24 attached to the case bottom 21*a* of the case body 21 in the circuit unit case 20. Rotation of the mount 10 with respect to the circuit unit case 20 is restricted upon the engaging portion 12*c* coming into contact with the stopper 24*a* provided in the stopper ring 24.

Accordingly, the mount 10 is rotatable over a range from where the engaging portion 12*c* contacts with one side of the stopper 24*a* in a circumferential direction until the engaging portion 12*c* contacts with the other side of the stopper 24*a*. As a result, the mount 10 is rotatable in either circumferential direction over a range of less than 360° (approximately 350°) in a region other than where the stopper 24*a* in the stopper ring 24 is provided.

When mounting this bulb-shaped LED lamp 1 into the lighting fixture 70 for incandescent bulbs as shown in FIG. 1, a user inserts the bulb-shaped LED lamp 1 through the opening at the bottom of the fixture body 71, which is attached to the ceiling, while holding onto the mount 10. The user then rotates the mount 10 in a predetermined direction in the fixture body 71 in order to screw the base 30 of the bulb-shaped LED lamp 1 into the socket 72. Rotation in the predetermined direction is hereinafter referred to as rotation in the normal direction.

In this case, the user can rotate the mount 10 in the normal direction in a comparatively large space near the opening at the bottom of the fixture body 71.

If the engaging portion 12*c* in the mount 10 is not in contact with one side of the stopper 24*a*, which would restrict rotation in the normal direction, then only the mount 10 rotates with respect to the circuit unit case 20 until the engaging portion 12*c* contacts with one side of the stopper 24*a*, without the circuit unit case 20 rotating. Accordingly, in this case, the base 30 attached to the circuit unit case 20 does not rotate, and therefore the base 30 does not connect with the socket 72 of the lighting fixture 70.

Note that in this case, by rotating the mount 10 in the normal direction, the support 40 that is integrally formed with the mount 10 also rotates in the normal direction with respect to the circuit unit case 20. Accordingly, the circuit substrate 56*a* that is integrally formed with the support 40 rotates with respect to the circuit unit case 20. As a result, the twisted wires 35 that are connected to both the base 30 and the circuit substrate 56*a* are twisted.

In the case body 21, however, the twisted wires 35 are bent within the case body 21 in order to rotate with the circuit substrate 56*a* over a 360° range. Furthermore, since the mount 10 cannot rotate 360° with respect to the circuit unit case 20, the support 40 also does not rotate 360° with respect to the circuit unit case 20. Accordingly, there is no risk of the twisted wires 35 being disconnected or damaged.

Subsequently, when the engaging portion 12*c* of the mount 10 contacts with one side of the stopper 24*a*, rotation of the mount 10 with respect to the circuit unit case 20 is restricted. The user, however, needs to continue rotating the mount 10 in the normal direction in order to mount the base 30 into the socket 72. Therefore, the user continues to rotate the mount 10 in the normal direction.

The mount bottom surface 12*b* of the mount bottom section 12 of the mount 10 is pushed by the stopper ring 24, attached to the circuit unit case 20, against the tip of the base 30 via the washer 61 and the insulating ring 62. The mount bottom surface 12*b* of the mount 10 is thus sandwiched between the stopper ring 24 and the washer 61. Accordingly, the user needs to rotate the mount 10 in the normal direction with a force larger than the force of friction acting between the mount bottom surface 12*b* and each of the stopper ring 24 and the washer 61.

By doing so, the engaging portion 12*c* of the mount 10 pushes against the stopper 24*a*, with which the engaging portion 12*c* is in contact, in the normal direction of rotation. Subsequently, by rotating the mount 10 in the normal direction, the stopper 24*a* and the engaging portion 12*c* integrally rotate in the normal direction. As a result, the circuit unit case 20 and the mount 10 also integrally rotate in the normal direction. The base 30, which is integrated with the connector 22, rotates in the normal direction and is thus screwed into the socket 72.

When the base 30 of the bulb-shaped LED lamp 1 is thus screwed into the socket 72, the user can confirm whether the LED module 51 is visible through the light transmissive portion of the globe 55 from beneath the fixture body 71, the LED module 51 being attached to the support 40, which in turn is integrated with the mount 10. If the entire LED module 51 cannot be seen due to the reflective film 55*a* of the globe 55, then the light-emitting direction of the LED module 51 does not face downwards. The mount 10 should therefore be rotated in the direction opposite the normal direction.

This rotation in the reverse direction also requires a force slightly larger than the friction between the mount bottom surface 12*b* of the mount 10 and each of the stopper ring 24 and the washer 61.

By rotating the mount 10 in the reverse direction, the support 40 that is integrated with the mount 10 also rotates in the same direction as the mount 10, i.e. the reverse direction. Once the LED module 51 becomes visible through the globe 55, the mount 10 is further rotated in the reverse direction so that the light-emitting direction of the LED module 51 points towards a desired region beneath the fixture body 71.

When the region illuminated by light from the LED module 51 corresponds to the desired region below the fixture body 71, the user stops rotating the mount 10 in the reverse direction.

At this point, the mount 10 is supported so as not to rotate with respect to the circuit unit case 20 due to pressure from the stopper ring 24 and the washer 61 acting on the mount bottom surface 12*b* of the mount 10.

With this structure for the bulb-shaped LED lamp 1 of the present embodiment, when mounting the base 30, which is integrally connected to the circuit unit case 20, into the socket 72 of the existing lighting fixture 70 for incandescent bulbs, it suffices to rotate the mount 10 within the fixture body 71 in the predetermined direction. Subsequently, in order to adjust the light-emitting direction of the LED module 51, it suffices to rotate the mount 10 in the reverse direction.

Accordingly, once the bulb-shaped LED lamp 1 is mounted into the socket 72 of the lighting fixture 70, it suffices for there to be space to rotate the mount 10 within the fixture body 71. It is not necessary to provide space within the fixture body 71 for adjusting the light-emitting direction of the LED module 51. As a result, the bulb-shaped LED lamp 1 can be enlarged until nearly coming into contact with the inner surface of the fixture body 71.

Thus increasing the size of the bulb-shaped LED lamp 1 allows for an increase in size of the circuit unit case 20 as well. Since the size of the electronic components of the lighting circuit unit 56 housed in the circuit unit case 20 can also therefore be increased, the amount of power supplied to the LED module 51 can be increased. This allows for high-power output by the LED module 51.

Furthermore, since the light-emitting direction of the LED module 51 can be changed by changing the configuration of the support 40, which is integrally formed with the mount 10, light can be shone on a predetermined region below the lighting fixture 70. It is therefore possible to configure the bulb-shaped LED lamp 1 so as to obtain the optimum amount of light for the predetermined region in accordance with the intended use of the lighting fixture 70.

Note that in the present embodiment, since the support 40 formed from aluminum, which has a high thermal conductivity, and the mount 10, which is also formed from aluminum, press against each other, the support 40 and the mount 10 thermally conduct with each other. Accordingly, the heat released by the LED module 51 is transferred to the mount 10 via the support 40 and radiated by the mount 10. The mount 10 thus functions as a heat sink.

Increasing the size of the bulb-shaped LED lamp 1 allows for an increase in the size of the mount 10, thereby allowing for an improvement in the efficiency of radiation by the mount 10 of heat from the LED module 51. Furthermore, forming an alumite layer or a predetermined synthetic resin layer on the outer circumferential surface of the mount 10 further improves the heat dissipation characteristics.

Note that the mount 10 and the support 40 are not limited to aluminum but may also be formed by another material with high thermal conductivity, such as another metal. In this case as well, thermal conductivity can be increased by a coating or the like of a layer of a predetermined synthetic resin on the outer circumferential surface.

In the present embodiment, the end face 42*a* of the support base 42 to which the LED module 51 is attached is inclined at, for example, a 25° angle with respect to a line perpendicular to the central axis of the mount 10, so that the light axis of the LED chips 51*b* is inclined at a 25° angle with respect to the central axis of the mount 10. The present invention is not limited, however, to this structure.

If the end face 42*a* of the support base 42 is greatly inclined with respect to a line perpendicular to the central axis of the mount 10, however, so that the light axis of the LED chips 51*b* has a large inclination angle with respect to the central axis of the mount 10, then the support base 42 protrudes greatly from the tip of the mount 10, thus preventing the bulb-shaped LED lamp 1 from being mounted in a conventional downlight fixture.

Conversely, if the end face 42*a* of the support base 42 is only slightly inclined with respect to a line perpendicular to the central axis of the mount 10, so that the light axis of the LED chips 51*b* has a small inclination angle with respect to the central axis of the mount 10, then light emitted by the LED chips 51*b* may not sufficiently illuminate the area below the existing downlight fixture.

Therefore, it is preferable for the end face 42*a* of the support base 42 to be inclined with respect to a line perpendicular to the central axis of the mount 10 so that the light axis of the LED chips 51*b* is inclined at an angle of approximately 25° to 80° with respect to the central axis of the mount 10.

In the present embodiment, both the stopper ring 24 and the washer 61 press against the mount bottom surface 12*b* of the mount 10 so that the rotational position of the mount 10 with respect to the circuit unit case 20 can be fixed at any position. Alternatively, a positioning mechanism may be provided to fix the rotational position of the mount 10 with respect to the circuit unit case 20 at a predetermined position.

For example, on the surface of the stopper ring 24 facing the mount bottom surface 12*b*, one or more concavities may be provided at predetermined positions in the circumferential direction. A projection may then be provided on the mount bottom surface 12*b* to engage with the concavities. With this structure, when the mount 10 is rotated with respect to the circuit unit case 20, the projection provided on the mount bottom surface 12*b* slides along the surface of the stopper ring 24 and engages with one of the concavities provided at the predetermined positions, thereby positioning the mount bottom surface 12*b* with respect to the stopper ring 24.

By providing this positioning mechanism, the mount 10 can be positioned with respect to the circuit unit case 20 at predetermined rotational positions. Accordingly, the region illuminated by light from the LED module 51 that rotates integrally with the mount 10 can easily be set to predetermined positions.

Note that the mechanism for positioning the mount 10 is not limited to this structure. Alternatively, concavities may be provided on the mount bottom surface 12*b*, with a projection provided on the stopper ring 24. Furthermore, a positioning mechanism with a different structure may be adopted.

Modification 1 to Embodiment 1

Figure 7A:
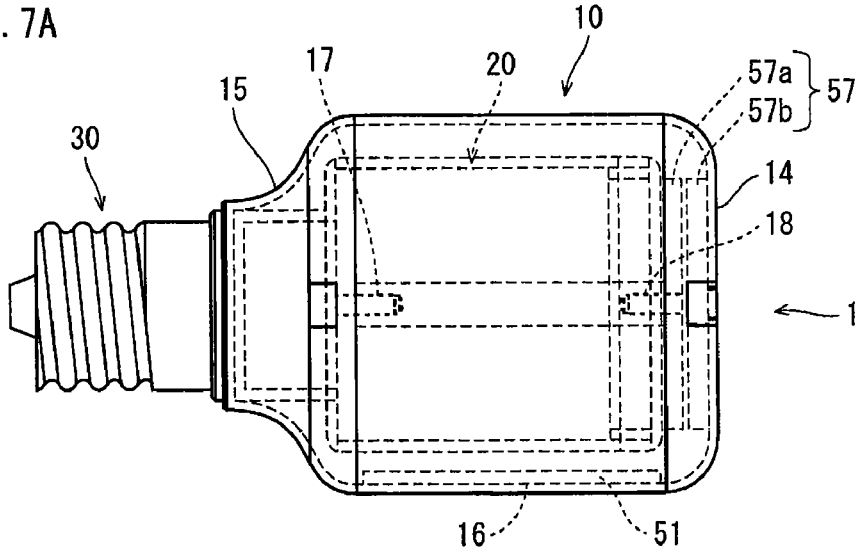
FIG. 7A is a lateral view of a bulb-shaped LED lamp in a modification of Embodiment 1 of the present invention.
Figure 7B:
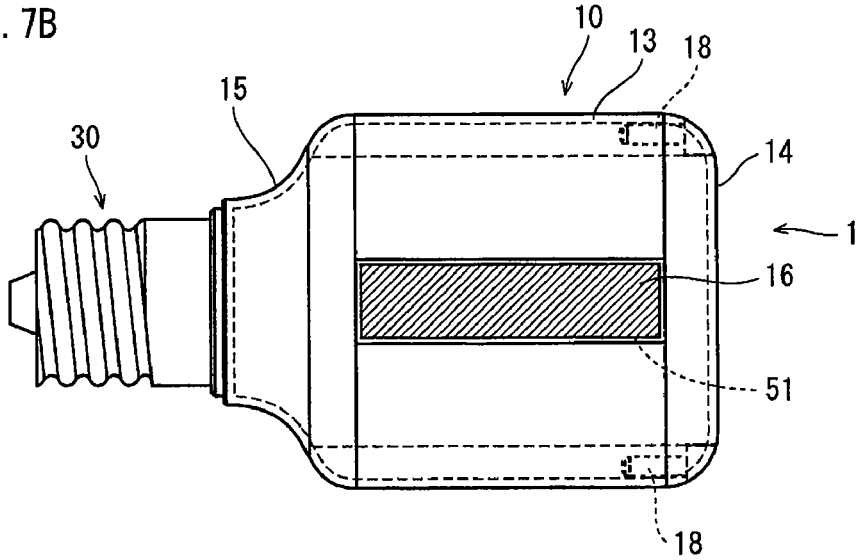
FIG. 7B is a bottom view of the bulb-shaped LED lamp.
Figure 7C:
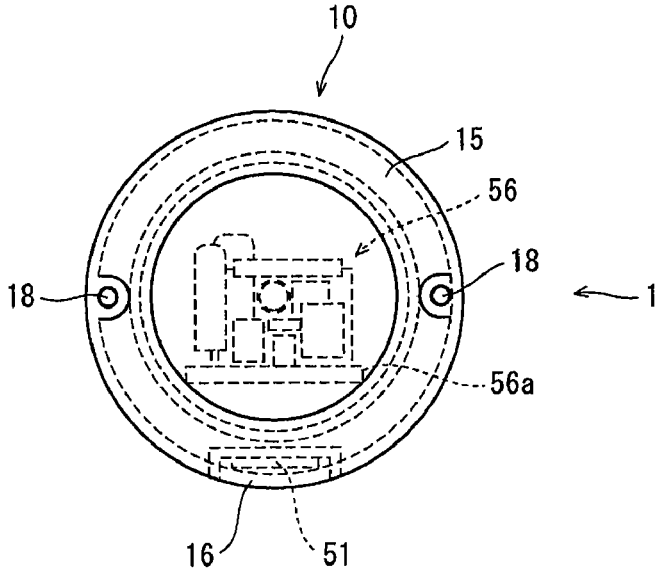
FIG. 7C is a front view of the bulb-shaped LED lamp.
Figure 8:
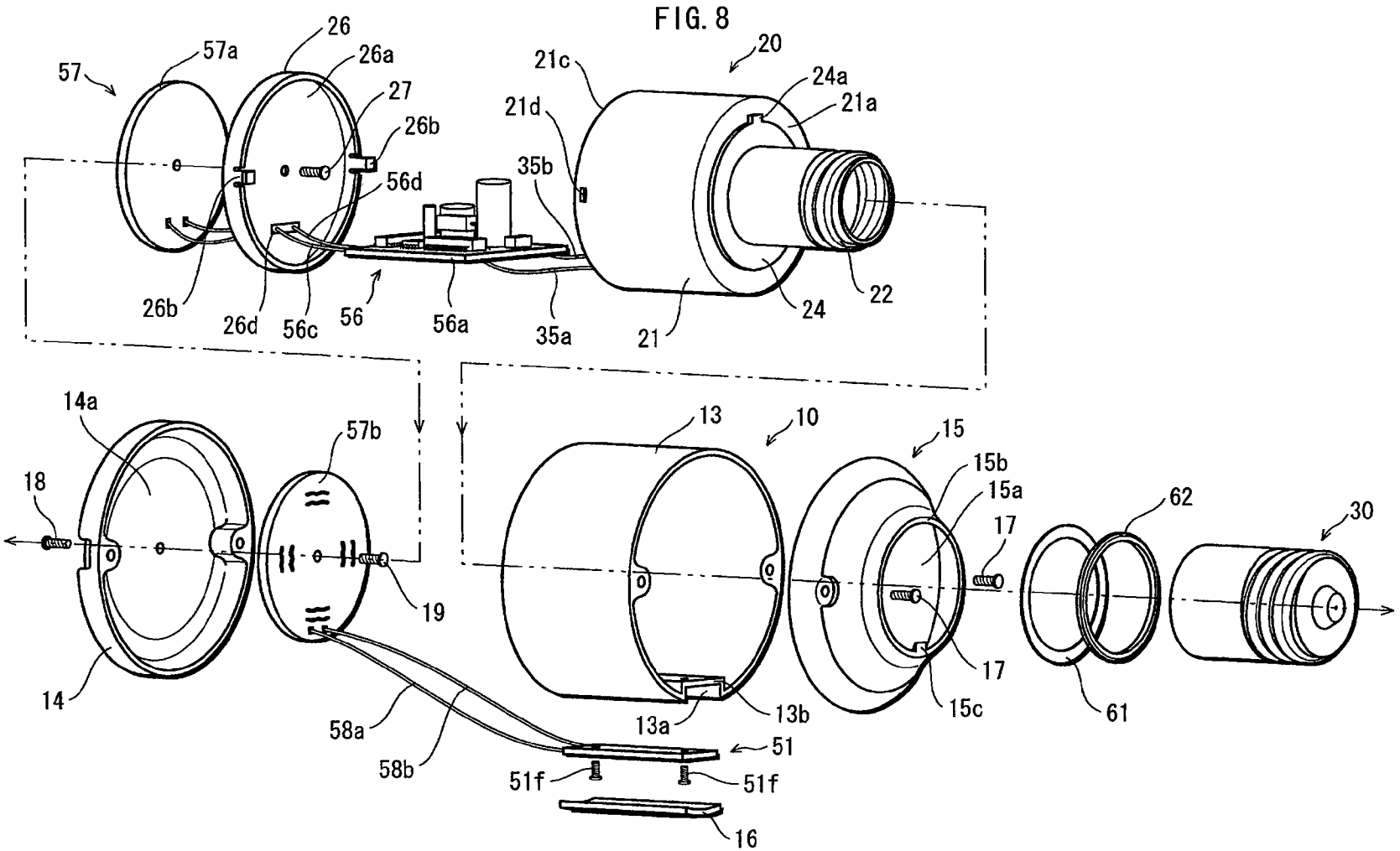
FIG. 8 is an exploded perspective view of the bulb-shaped LED lamp.

FIG. 7A is a lateral view of a bulb-shaped LED lamp 1 in Modification 1 of Embodiment 1, FIG. 7B is a bottom view of this bulb-shaped LED lamp 1, and FIG. 7C is a front view of this bulb-shaped LED lamp 1. FIG. 8 is an exploded perspective view of this bulb-shaped LED lamp 1.

This bulb-shaped LED lamp 1 includes a mount 10 in the shape of a circular cylinder, a circuit unit case 20 that is in the shape of a circular cylinder and is engaged with the mount 10, and a base 30 that is in the shape of a circular cylinder and connected to the circuit unit case 20.

As shown in FIG. 8, like the circuit unit case 20 of the bulb-shaped LED lamp 1 described above, the circuit unit case 20 has a case body 21 and a connector 22 that are formed integrally with insulating synthetic resin. A cross-section of the case body 21, however, is a circle with a constant diameter, and a lighting circuit unit 56 is housed inside the case body 21. One end face of the case body 21 is a case opening 21*c*, and the other end face is a case bottom 21*a*. As in the bulb-shaped LED lamp 1 described above, the connector 22 is provided at the central region of the case bottom 21*a*.

The structure of the connector 22 and of the base 30 in this modification is similar to the structure of the connector 22 and the base 30 in the bulb-shaped LED lamp 1 described above. Furthermore, a stopper ring 24 is attached to the case bottom 21*a*. In this modification, a stopper 24*a* is provided at one location in the circumferential direction of the stopper ring 24, protruding diametrically outwards.

Note that in this modification, the case opening 21*c* in the case body 21 is sealed by a cap 26 integrally attached to the case body 21. The cap 26 is closed off at one end by an end face 26*a*. The cap 26 is in the shape of a circular cylinder having a shorter length in the axial direction than the case body 21. The opposite end face from the closed off end face 26*a* is open.

Along the circumference of the cap 26, a pair of engaging portions 26*b* is provided. The engaging portions 26*b* extend from the open end face of the cap 26, traverse the case opening 21*c*, and are inserted into the case body 21. The engaging portions 26*b* extend towards the case body 21 respectively from positions along the circumference of the cap 26 that are symmetrical about the central axis. Engaging parts that are bent outwards are provided at the tips of the engaging portions 26*b*.

Engaging holes 21*d* with which the engaging parts of the engaging portions 26*b* engage are provided at the end of the case body 21 by the case opening 21*c*. The cap 26 is fixed to the case body 21 by the engaging portions 26*b* traversing the case opening 21*c* and being inserted into the case body 21, with the engaging parts at the tips of the engaging portions 26*b* engaging with the engaging holes 21*d*. The end face 26*a* of the cap 26 thus seals the case opening 21*c*.

The lighting circuit unit 56 housed within the case body 21 has a circuit substrate 56*a* on which is mounted a plurality of electronic components, such as a rectifying/smoothing circuit, a DC/DC converter, and the like. The circuit substrate 56*a* is attached within the case body 21 so as to be parallel to the central axis of the case body 21 at an appropriate distance from the central axis. One end of each of a first electric supply line 35*a* and a second electric supply line 35*b* is connected to the base 30, the other end of each being connected to the circuit substrate 56*a*. The first electric supply line 35*a* and the second electric supply line 35*b* supply current to the electronic components on the circuit substrate 56*a*.

Note that, as described below, one end of a first power line 56*c* and of a second power line 56*d* that supply power to the LED module 51 attached to the mount 10 are connected to the electronic components on the circuit substrate 56*a*. The first power line 56*c* and the second power line 56*d* traverse a power line through-hole 26*d* provided in the cap 26 and extend outside of the case body 21.

A fixing-side terminal substrate 57*a* of a rotary contact 57 is attached to the end face 26*a* of the cap 26 at the opposite side thereof from the case body 21. The fixing-side terminal substrate 57*a* is in the shape of a circular plate, like the end face 26*a* of the cap 26, and is coaxially attached to the end face 26*a* of the cap 26 by a screw 27 attached along the central axis of the end face 26*a*.

Note that the rotary contact 57 includes a rotating-side terminal substrate 57*b* that is rotatable about the same axis as the fixing-side terminal substrate 57*a*. The rotating-side terminal substrate 57*b*, as described below, is attached to a lid 14 that seals one end face of the mount 10.

In this modification, the mount 10 that houses the case body 21 of the circuit unit case 20 includes a mount body 13, in the shape of a circular cylinder whose cross-section has a constant diameter, and a mount bottom 15 attached to the opposite end face of the mount body 13 from the end face to which the lid 14 is attached.

The mount bottom 15 attached to the end face of the mount body 13 includes a through-hole 15*a* in the central region of the mount bottom 15. The connector 22 of the circuit unit case 20 passes through the through-hole 15*a*. The through-hole 15*a* is centered on the central axis of the mount body 13 and is a circle with a slightly larger diameter than the outer diameter of the connector 22. The mount bottom 15 also includes a flat surface 15*b* that surrounds the through-hole 15*a* and is perpendicular to the central axis of the mount body 13. An engaging portion 15*c* protrudes inwards (towards the central axis of the mount bottom 15) at one location along the circumference of the flat surface 15*b*. The mount bottom 15 is attached to the circumferential surface of the mount body 13 by a pair of screws 17.

The circuit unit case 20 is configured so that the case body 21 is housed inside the mount body 13, with the connector 22 passing through the through-hole 15*a* of the mount bottom 15 to project outside of the mount 10. Like the above-described bulb-shaped LED lamp 1, the base 30 engages with a washer 61 and an insulating ring 62 when connected to the connector 22.

When the stopper ring 24 attached to the case bottom 21*a* is positioned within the through-hole 15*a* of the mount bottom 15, the flat surface 15*b* is sandwiched between the case bottom 21*a* and the washer 61. In this state, the compressive force from the base 30 acts on the flat surface 15*b* of the mount bottom 15 via the insulating ring 62 and the washer 61, and the flat surface 15*b* is pressed against the case bottom 21*a* by the washer 61.

Due to this compressive force, the mount bottom 15 is fixed with respect to the connector 22. Accordingly, the mount 10 is fixed with respect to the circuit unit case 20. Furthermore, in this state, if the mount 10 is rotated so that a force applied to the flat surface 15*b* of the mount bottom 15 is larger than the friction between the flat surface 15*b* and each of the case bottom 21*a* and the washer 61, the flat surface 15*b* rotates around the stopper ring 24 provided on the case bottom 21*a* while being pressed against the case bottom 21*a*.

As a result, the entire mount 10 rotates with respect to the circuit unit case 20. When the entire mount 10 rotates a predetermined amount in a predetermined direction with respect to the circuit unit case 20, the flat surface 15*b* of the mount bottom 15 rotates around the stopper ring 24, and the engaging portion 15*c* provided on the mount bottom 15 contacts with the stopper 24*a*. Rotation of the mount 10 in predetermined directions is restricted by the engaging portion 15*c* coming into contact with the stopper 24*a*. The stopper ring 24 that includes the stopper 24*a* and the engaging portion 15*c* provided on the mount bottom 15 thus form a restricting member that restricts the rotation of the mount 10.

On the circumferential surface of the mount body 13, which is in the shape of a circular cylinder, a groove 13*a* is provided along the direction of the central axis of the mount body 13. The groove 13*a* is for attaching the LED module 51 and is a concavity with an opening facing the outer circumference of the mount body 13. The groove 13*a* includes a flat groove bottom 13*b* at the inner circumferential side of the groove 13*a*. The groove bottom 13*b* is a flat surface parallel to the circuit substrate 56*a* attached inside the mount body 13. The groove bottom 13*b* has a constant width along the axial direction.

The LED module 51 attached to the groove bottom 13*b* includes an elongated, rectangular mounting substrate that abuts the groove bottom 13*b*. A plurality of LED chips are mounted on the mounting substrate, and all of the LED chips are sealed by a phosphor-containing resin. The LED chips are arranged in one or more rows in the direction of length of the mounting substrate.

The LED module 51 is attached to the groove bottom 13*b* at either end in the direction of length of the mounting substrate by screws 51*f*, so that the back side of the LED module 51 opposite the mounting substrate on which the LED chips are mounted abuts the groove bottom 13*b* of the groove 13*a*. A glass cover 16 that covers the LED module 51 is attached to the opening of the groove 13*a*.

The lid 14, which closes off one end face of the mount 10, is closed off at one end face 14*a*. The lid 14 is in the shape of a circular cylinder having a shorter length in the axial direction than the mount body 13. The opposite end face from the closed off end face 14*a* is open. The open end face 14*a* of the lid 14 is attached to the circumferential surface of the mount body 13 by a pair of screws 18 so as to abut one end face of the mount body 13.

The rotating-side terminal substrate 57*b* of the rotary contact 57 is provided inside the lid 14. The rotating-side terminal substrate 57*b* is in the shape of a circular plate, like the fixing-side terminal substrate 57*a* of the rotary contact 57, and is concentrically attached to the end face 14*a* facing the end face 26*a* of the cap 26 by a screw 19. The rotating-side terminal substrate 57*b* is thus slidable with respect to the fixing-side terminal substrate 57*a* of the rotary contact 57 attached to the cap 26 of the circuit unit case 20 housed in the mount body 13.

A 10 μm alumite layer (anodic oxide coating or white alumite coating), for example, is formed by alumite treatment, like the mount 10 in the above-described bulb-shaped LED lamp 1, along the outer circumferential surface of the mount 10, except for the portion where the groove 13*a* for attaching the LED module 51 is formed. This alumite layer increases the thermal conductivity of the mount 10.

Note that in this modification as well, instead of forming an alumite layer on the outer circumferential surface of the mount 10, heat dissipation characteristics may also be improved by applying a predetermined synthetic resin to the outer circumferential surface of the mount 10.

Figure 9A:
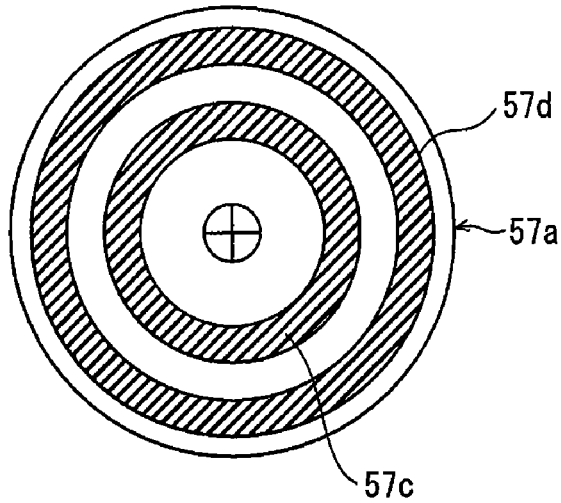
FIG. 9A is a plan view of a sliding surface of a fixing-side terminal substrate in a rotary contact.
Figure 9B:
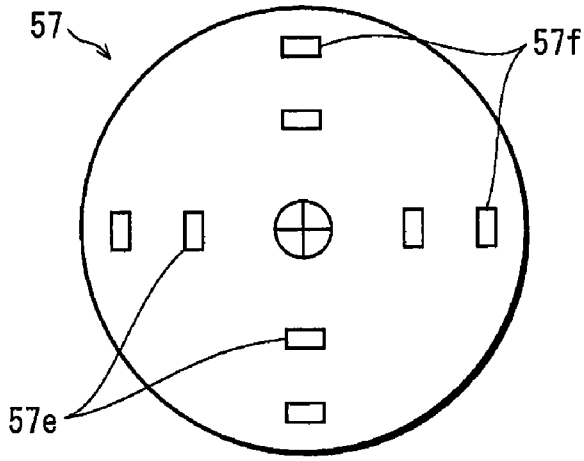
FIG. 9B is a plan view of a sliding surface of a rotating-side terminal substrate in the rotary contact.
Figure 9C:
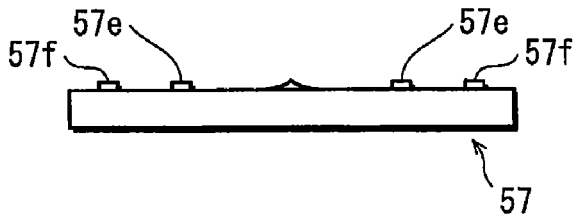
FIG. 9C is a lateral view of the rotating-side terminal substrate.

FIG. 9A is a plan view of the surface of the fixing-side terminal substrate 57*a* in the rotary contact 57 facing the rotating-side terminal substrate 57*b* (the sliding surface). FIG. 9B is a plan view of the surface of the rotating-side terminal substrate 57*b* facing the fixing-side terminal substrate 57*a* (the sliding surface). FIG. 9C is a lateral view of the rotating-side terminal substrate 57*b*.

As shown in FIG. 9A, a concentric, ring-shaped pair of an inner circumferential terminal 57*c* and an outer circumferential terminal 57*d* are provided on the sliding surface of the fixing-side terminal substrate 57*a*. One end of the first electric supply line 35*a* and one end of the second electric supply line 35*b* are attached to the circuit substrate 56*a*, and the other end of each electric supply line is attached respectively to the inner circumferential terminal 57*c* and the outer circumferential terminal 57*d*.

As shown in FIG. 9B, four inner circumferential contact points 57*e* that slide against the inner circumferential terminal 57*c* are provided at equal circumferential intervals on the sliding surface of the rotating-side terminal substrate 57*b*. Furthermore, four outer circumferential contact points 57*f* that slide against the outer circumferential terminal 57*d* are provided closer to the outer circumference of the rotary contact 57 than the corresponding inner circumferential contact points 57*e*. Accordingly, even if the mount 10 rotates with respect to the circuit unit case 20, the inner circumferential contact points 57*e* and the outer circumferential contact points 57*f* of the rotating-side terminal substrate 57*b* maintain contact with the inner circumferential terminal 57*c* and the outer circumferential terminal 57*d* of the fixing-side terminal substrate 57*a*.

The four inner circumferential contact points 57*e* are connected to a single first lead wire 58*a* (see FIG. 8), and the four outer circumferential contact points 57*f* are connected to a single second lead wire 58*b* (see FIG. 8). The first lead wire 58*a* and the second lead wire 58*b* are connected to respective wiring patterns provided on the mounting substrate of the LED module 51. The LED chips on the LED module 51 are connected to the wiring patterns.

In the bulb-shaped LED lamp with this structure as well, the mount 10 is rotatable over a range of less than 360° with respect to the circuit unit case 20. Like the above-described bulb-shaped LED lamp 1, when the base 30 is mounted into the socket 72 in the lighting fixture 70 for typical incandescent bulbs as shown in FIG. 1, the mount 10 is rotated in the normal direction in a comparatively large space near the opening at the bottom of the fixture body 71. The mount 10 is rotated with respect to the circuit unit case 20 until the engaging portion 15*c* provided in the mount bottom 15 of the mount 10 contacts with the stopper 24*a*.

Since the lighting circuit unit 56 housed in the circuit unit case 20 and the LED module 51 attached to the mount 10 are electrically connected by the rotary contact 57, the mount 10 smoothly rotates with respect to the circuit unit case 20 without risk of disconnection or damage to the electrical wiring connecting the lighting circuit unit 56 and the LED module 51 with the rotary contact 57.

After the engaging portion 15*c* provided in the mount bottom 15 of the mount 10 and the stopper 24*a* come into contact, the circuit unit case 20, which is formed integrally with the mount 10, subsequently rotates. The base 30 integrally assembled with the circuit unit case 20 thus rotates integrally with the mount 10, enabling the base 30 to be mounted into the socket 72.

Upon mounting the base 30 into the socket 72, the region illuminated by the LED module 51 attached to the outer circumferential surface of the mount 10 can be adjusted to a predetermined position below the lighting fixture 70 by rotating the mount 10 with respect to the circuit unit case 20. Note that in this case as well, the mount 10 can be smoothly rotated with respect to the circuit unit case 20 without risk of disconnection or damage to the electrical wiring connecting the lighting circuit unit 56 and the LED module 51 with the rotary contact 57.

Accordingly, in the bulb-shaped LED lamp 1 according to this modification as well, the user can rotate the mount 10 in the normal direction in a comparatively large space near the opening at the bottom of the fixture body 71. This makes it easy to rotate the mount 10 in the normal direction.

Since the LED module 51 attached to the outer circumferential surface of the mount 10 is parallel to the central axis of the mount 10, the LED module 51 can be provided along the entire length of the outer circumferential surface of the mount 10 parallel to the central axis thereof. This allows for the size of the LED module 51 to be increased, thus increasing the amount of light emitted by the LED module 51.

Furthermore, the size of the circuit unit case 20 housed inside the mount 10 may be increased, since it is not necessary to set aside space for the LED module 51 inside the mount 10. As a result, since the size of the electronic components of the lighting circuit unit 56 housed in the circuit unit case 20 can be increased, the amount of power supplied to the LED module 51 can be increased. This allows for high-power output by the LED module 51.

Furthermore, by providing the LED module 51 on the outer circumferential surface of the mount 10, the size of the mount 10 can be increased to the maximum volume that fits within the fixture body 71 of the lighting fixture 70. The mount 10 formed by aluminum, which has a high thermal conductivity, functions as a heat sink for the LED module 51. Therefore, increasing the size of the mount 10 allows for an improvement in the efficiency of radiation by the mount 10 of heat from the LED module 51. Furthermore, forming an alumite layer or a predetermined synthetic resin layer on the outer circumferential surface of the mount 10 further improves the heat dissipation characteristics.

Note that in this modification, the light axis of the LED chips 51*b* in the LED module 51, which is attached to the outer circumferential surface of the mount 10, is perpendicular to a plane that lies along the outer circumferential surface of the mount 10. The light axis is not, however, limited to this structure. The light axis of the LED chips 51*b* may be inclined at a predetermined angle with respect to a plane that lies along the outer circumferential surface of the mount 10.

Furthermore, in this modification as well, a mechanism may be provided to position the mount 10 with respect to the circuit unit case 20, as described in Embodiment 1.

Embodiment 2

Figure 10:
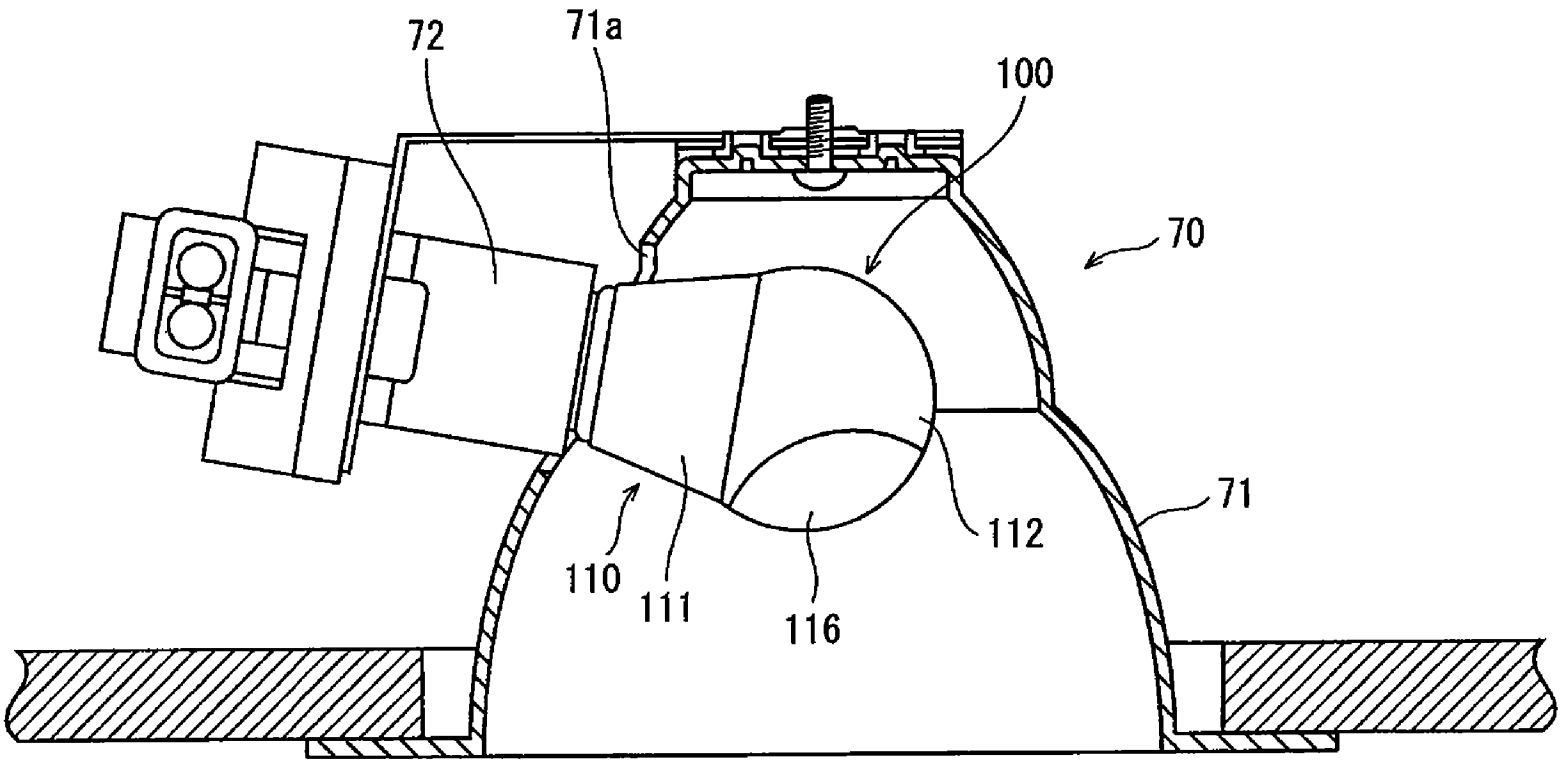
FIG. 10 is a cross-section diagram of a lighting fixture for a typical incandescent light bulb into which a bulb-shaped LED lamp according to Embodiment 2 of the present invention has been mounted.

FIG. 10 is a cross-section diagram of a lighting fixture for a typical incandescent light bulb into which a bulb-shaped LED lamp 100 according to Embodiment 2 has been mounted. Like the lighting fixture 70 shown in FIG. 1, the lighting fixture 70 shown in FIG. 10 includes a hemispherical (bowl shaped) fixture body 71 attached to the ceiling and a socket 72 attached to the fixture body 71. The socket 72 is supported externally to the fixture body 71 with an insertion opening, into which the base of a typical incandescent bulb is inserted, facing an opening 71*b* formed on the peripheral surface of the fixture body 71. The socket 72 is slightly inclined with respect to the horizon so that the insertion opening is tilted downwards.

Figure 11:
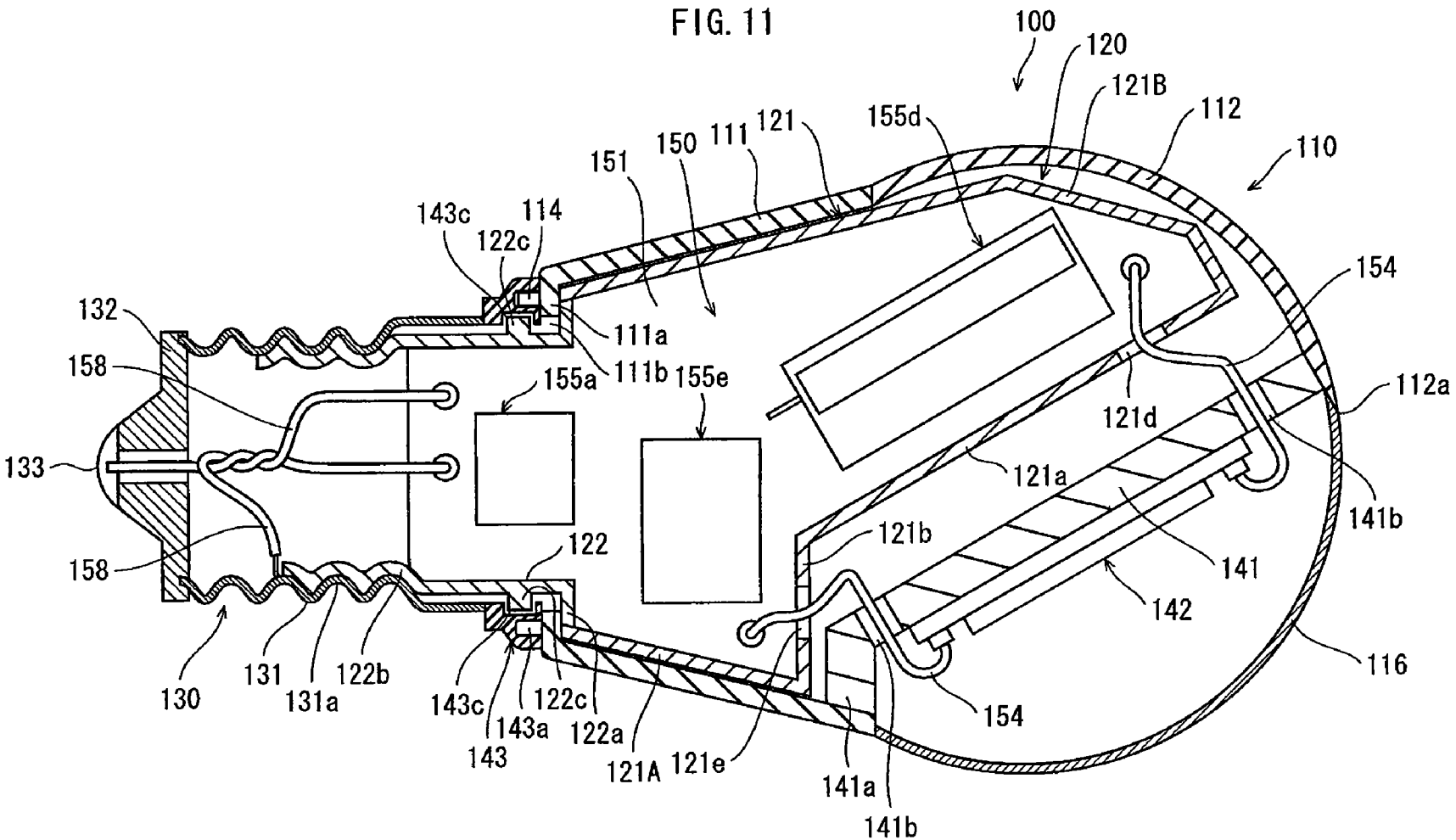
FIG. 11 is a lateral cross-section diagram showing the structure of the bulb-shaped LED lamp.

FIG. 11 is a cross-section diagram showing the structure the bulb-shaped LED lamp 100 in the present embodiment.

The bulb-shaped LED lamp 100 of the present embodiment includes a housing 110, a module support 141, an LED module 142, a base 130, a circuit case 120, and a lighting circuit unit 150. The housing 110 is in the shape of a bulb formed by a combination of a circular truncated cone with a sphere. The module support 141 is integrally attached to the inside of the housing 110. The LED module 142 is attached to the module support 141. The base 130 is attached to an end of the housing 110 and is rotatable over a predetermined range. The circuit case 120 is provided within the housing 110 and the base 130. The lighting circuit unit 150 is provided within the circuit case 120.

The housing 110 includes a main housing 111 in the shape of a hollow, circular truncated cone and a housing receptacle 112 in the shape of a hollow sphere. The housing receptacle 112 is connected to the end of the main housing 111 with the larger diameter. The main housing 111 and the housing receptacle 112 are coaxial and are internally continuous with each other. The housing 110 is, for example, formed by first forming the main housing 111 and the housing receptacle 112 to a constant thickness of approximately 1.5 mm to 3 mm by die casting aluminum, which has excellent heat dissipation characteristics. The main housing 111 and the housing receptacle 112 are then integrally joined by, for example, being welded, bonded with adhesive, or screwed together.

An opening 112*a* is formed in the housing receptacle 112 by removing a circular portion of the spherical surface. The center of the opening 112*a* is located along an imaginary axis inclined at a 60° angle with respect to the central axis of the housing receptacle 112. The opening 112*a* is covered by a globe 116 of a similar shape as the portion of the spherical surface removed from the housing receptacle 112. The globe 116 is attached to the outer circumferential edge of the opening 112*a*.

The module support 141, on which the LED module 142 is mounted, is provided inside the housing receptacle 112. The module support 141 is in the shape of a circular plate facing and coaxial with the opening 112*a* in the housing receptacle 112. The module support 141 is inclined at a predetermined angle (approximately 30°) with respect to the central axis of the housing receptacle 112. The module support 141 includes a bent portion 141*a* that is bent to be perpendicular to the central axis of the main housing 111 at the end thereof with the larger diameter. The module support 141 and the inner circumferential surface of the housing 110 are integrally joined by, for example, being welded, bonded with adhesive, or screwed together. The LED module 142 is mounted on the end face (surface) of the module support 141 facing the globe 116.

An end face 111*a* is provided in the main housing 111 at an end thereof with the smaller diameter. The end face 111*a* includes a through-hole 111*b* in the center thereof. At one location in the circumferential direction of the end face 111*a*, a guide pin 114 that protrudes outwards in the axial direction is provided. As described below, the guide pin 114 slidably engages with a guide groove 143*a* in an insulating ring 143 provided between the end face 111*a* and the base 130. Together, the guide pin 114 and the guide groove 143*a* form a restricting member that restricts the housing 110 from rotating more than one rotation.

The circuit case 120 includes a case body 121 and a case connector 122. The case body 121 is provided within the housing 110. The case connector 122 is in the shape of a circular cylinder and is attached to an end of the case body 121 so as to be located within the base 130. The case body 121 includes a bottom section 121A and a tip section 121B. The bottom section 121A is in the shape of a circular truncated cone corresponding to the main housing 111. The tip section 121B projects from the bottom section 121A towards an end face (back surface) of the housing receptacle 112 opposite the globe 116 over the module support 141.

The bottom section 121A of the case body 121 engages with the main housing 111 and is integrally joined with the main housing 111 by, for example, being welded or bonded with adhesive. Alternatively, the bottom section 121A may be connected by a mechanism allowing the bottom section 121A to rotate along with the main housing 111. The tip section 121B of the case body 121 includes an inclined surface 121*a* and a flat surface 121*b*. The inclined surface 121*a* is inclined with respect to the central axis of the case body 121 so as to be parallel with the module support 141. The flat surface 121*b* is provided in parallel with the bent portion 141*a* of the module support 141.

The end of the case body 121 with the smaller diameter (by the base 130) is open. One end of the case connector 122, which is in the shape of a circular cylinder, is provided within this end of the case body 121. A flange 122*a* that extends circumferentially outwards is provided on the end of the case connector 122 located within the case body 121. The flange 122*a* is in sliding contact with the end face 111*a* of the main housing 111. The outer circumferential edge of the flange 122*a* abuts the inner circumferential surface of the edge of the case body 121.

A thread 122*b* is provided on the outer circumferential surface of the end of the case connector 122 that protrudes from the case body 121. The base 130 is connected to the thread 122*b*.

So that the base 130 can be mounted in a socket 172 of a lighting fixture 170, the base 130 for example complies with the standards for an E17 base as specified by the Japanese Industrial Standards (JIS). Note that the base 130 is not limited in this way to a structure complying with the standards for an E17 base. The base 130 may have a structure complying with other JIS standards (such as for an E26 base) in order to be mountable in sockets of other lighting fixtures.

The base 130 has a shell 131 in the shape of a circular cylinder. Along the circumferential surface of the shell 131, a thread 131*a* is provided for mounting the shell 131 into the socket 172 of the lighting fixture 170. Along the inner circumferential surface and the outer circumferential surface of the shell 131, screw grooves are formed by alternating peaks and valleys. The thread 122*b* provided on the outer circumferential surface of the case connector 122 is screwed into the screw groove along the inner circumferential surface of the shell 131. Accordingly, the shell 131 of the base 130 is integrally connected to the case connector 122.

An insulating connector 132 is provided in the shell 131 at the end thereof that is inserted into the socket 172. An eyelet 133 is attached to the outside of the insulating connector 132 at the center thereof.

The insulating ring 143 is provided in the shell 131 at the end thereof opposite the end where the insulating connector 132 is provided. The shell 131 of the base 130 presses the insulating ring 143 against the smaller diameter end of the main housing 111.

The insulating ring 143 is coaxial with the shell 131. Engaging grooves 143*b* are provided along the inner circumferential surface of the insulating ring 143 in the axial direction at two locations symmetric with respect to the axis. Along the outer circumferential surface of the case connector 122 that traverses the inside of the insulating ring 143, projections 122*c* that engage with the engaging grooves 143*b* are provided at two locations facing the engaging grooves 143*b*. When the case connector 122 is screwed into the shell 131, the projections 122*c* engage with the engaging grooves 143*b*. The insulating ring 143 is thus prevented from rotating with respect to the case connector 122.

Figure 12:
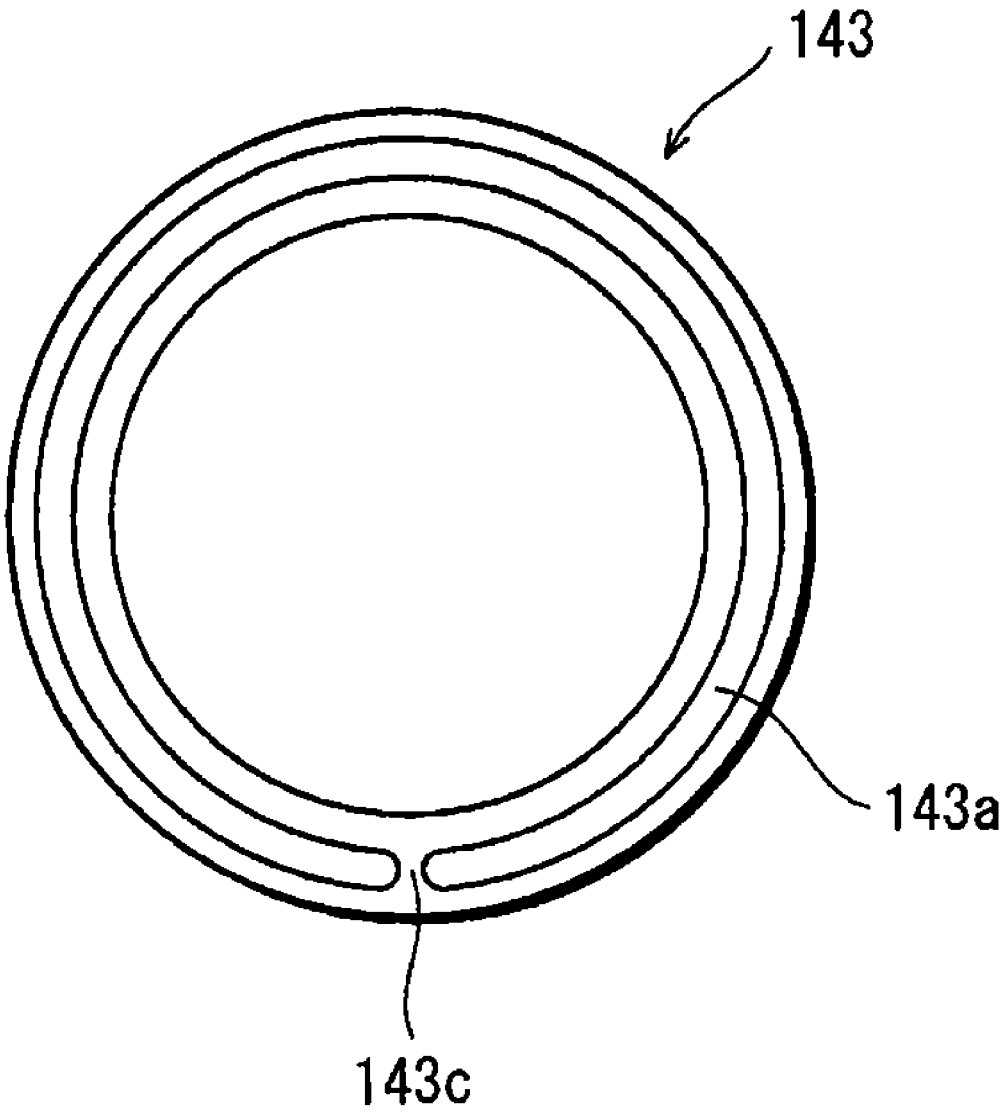
FIG. 12 is a plan view of an end face, by a housing, of an insulating ring provided in the bulb-shaped LED lamp.

FIG. 12 is a plan view of the end face of the insulating ring 143 by the housing 110. The guide groove 143*a* is provided on the end face of the insulating ring 143 by the housing 110. The guide groove 143*a* opens towards the housing 110 and is continuous in the circumferential direction with the exception of one location at which an engaging portion 143*c* is provided. Accordingly, the guide groove 143*a* is continuous in the circumferential direction over a range of approximately 355°. The guide pin 114 provided on the end face 111*a* of the housing 110 slidably engages with the guide groove 143*a*.

The insulating ring 143 is pressed against the end face 111*a* of the housing 110 by the base 130 being screwed into the case connector 122. When the insulating ring 143 is pressed against the end face 111*a* of the housing 110, the guide pin 114 provided on the end face 111*a* slidably engages with the guide groove 143*a*. Since the guide pin 114 slidably engages with the guide groove 143*a*, the guide pin 114 can slide in the circumferential direction over a range of approximately 355°. The guide pin 114 is thus restricted from making one complete rotation around the insulating ring 143.

With the insulating ring 143 pressed against the end face 111*a* of the housing 110, the projections 122*c* provided on the outer circumferential surface of the case connector 122 engage with the engaging grooves 143*b* provided in the insulating ring 143. The insulating ring 143 is thus prevented from rotating with respect to the case connector 122.

Accordingly, with the insulating ring 143 pressed against the end face 111*a* of the housing 110, the housing 110 does not rotate with respect to the insulating ring 143 as long as no rotational force is applied. By applying a rotational force to the housing 110, however, the housing 110 rotates while sliding against the insulating ring 143. Since the guide pin 114 does not rotate 360° within the guide groove 143*a*, the housing 110 is restricted from rotating 360° with respect to the base 130, which is integrated with the insulating ring 143.

Inside the housing 110 is provided the lighting circuit unit 150, which converts power provided by the base 130 into power corresponding to LED chips 142*a* (see FIG. 13) in the LED module 142. The lighting circuit unit 150 is provided with a flat circuit substrate 151 and a lighting circuit 155. The circuit substrate 151 is perpendicular to the module support 141 and lies along a flat plane that includes the central axis of the housing 110. The lighting circuit 155 is formed by a variety of electronic components mounted on a wiring pattern provided in the circuit substrate 151.

The outer circumferential edge of the circuit substrate 151 is housed within the circuit case 120 so as to border the inner circumferential surface of the case body 121 and the case connector 122 in the circuit case 120, as well as the inclined surface 121*a* and the flat surface 121*b* of the case body 121. A groove (not shown in the figures) with which the outer circumferential edge of the circuit substrate 151 engages is provided on the inner circumferential surface of the case body 121. The outer circumferential edge of the circuit substrate 151 is engaged with this groove. The circuit substrate 151 is thus supported within the case body 121 in the direction of the central axis thereof. Note that the circuit substrate 151 is rotatable with respect to the case connector 122.

The circuit substrate 151 is thus housed within the case body 121, from the inside of the housing receptacle 112 to the inside of the main housing 111. The portion of the circuit substrate 151 located within the case connector 122 is housed within the insulating ring 143 and within the side of the base 130 by the main housing 111. Within the housing receptacle 112, the circuit substrate 151 protrudes into the space facing the back surface opposite the surface of the module support 141 on which the LED module 142 is mounted.

The LED module 142 mounted on the module support 141 is, for example, a square printed circuit board with a plurality of LED chips 142*a*, which are light-emitting elements, mounted thereon. These LED chips 142*a* are connected in series by a wiring pattern provided on the printed circuit board. DC voltage that has been converted by the lighting circuit 155 on the circuit substrate 151 is applied to the wiring pattern by a pair of lead wires 154.

As shown in FIG. 11, the lead wires 154 pass through through-holes 141*b* provided in the module support 141 and through through-holes 121*d* and 121*e* provided respectively in the inclined surface 121*a* and the flat surface 121*b* of the case body 121 to connect with the lighting circuit 155 in the circuit substrate 151 and with the wiring pattern of the LED module 142.

A pair of lead wires 158 are provided at the tip of the circuit substrate 151 in the case connector 122 housed within the base 130. The lead wires 158 are connected to predetermined portions of the wiring pattern provided on the circuit substrate 151 and are twisted around each other. With the case connector 122 screwed into the base 130, one of the lead wires 158 is electrically connected by solder to the eyelet 133 provided at the tip of the base 130.

The other lead wire 158 is drawn outside of the case connector 122 and is electrically connected by solder to the shell 131 of the base 130. The pair of lead wires 158 are twisted together so that, with the case connector 122 screwed into the shell 131 of the base 130, the lead wires 158 are not disconnected even if the circuit substrate 151 rotates 360° with respect to the case connector 122, which is integrated with the base 130.

Figure 13:
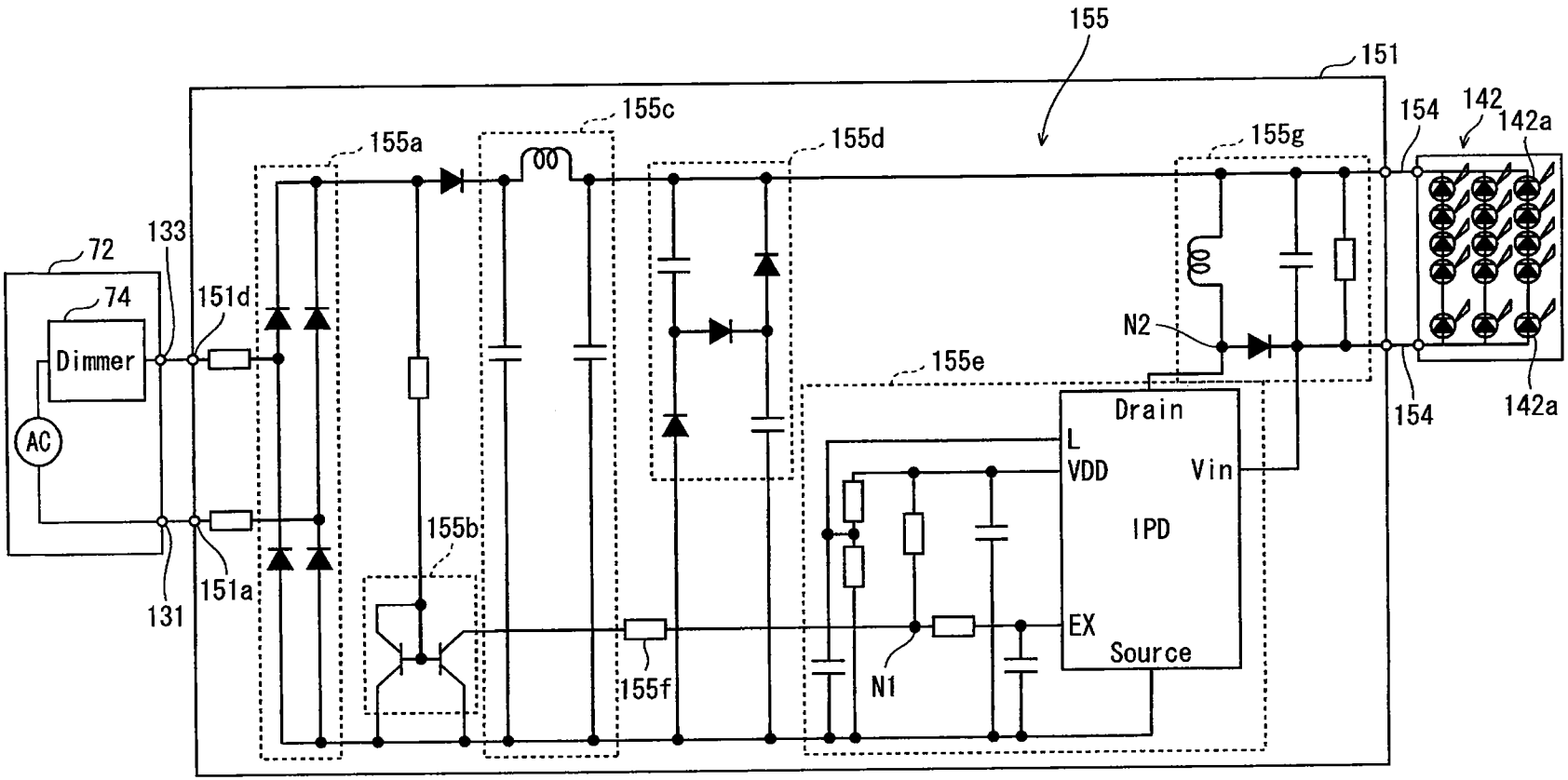
FIG. 13 is a circuit diagram of a lighting circuit in a lighting circuit unit provided in the bulb-shaped LED lamp.
Figure 14:
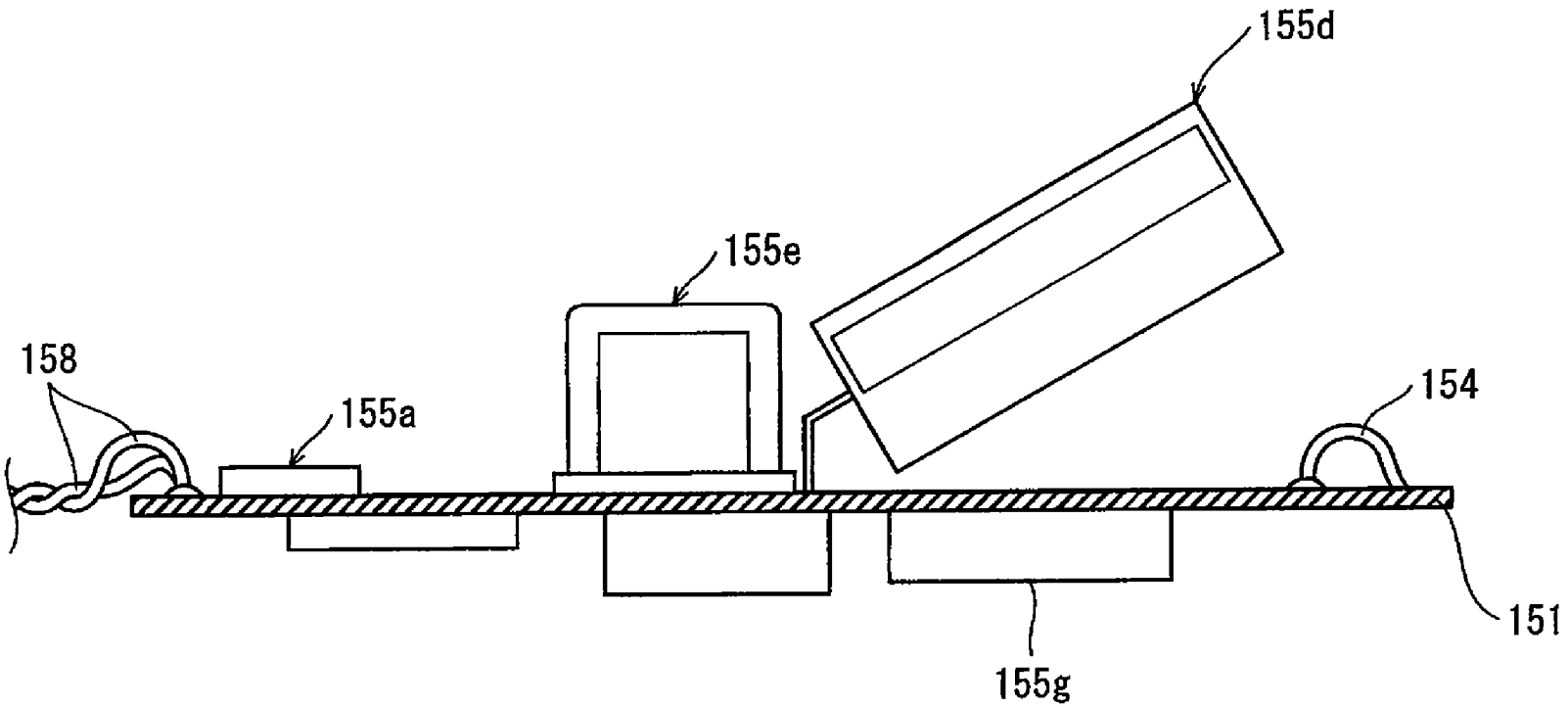
FIG. 14 is a lateral view of the lighting circuit unit provided in a circuit case.

FIG. 13 is a circuit diagram of the lighting circuit provided on the circuit substrate 151. By being mounted into the socket 72 of the lighting fixture 70, the AC power provided to the socket 72 is provided to the bulb-shaped LED lamp 100 of the present embodiment via the eyelet 133 and the shell 131 provided in the base 130 after being adjusted by a dimmer 74 provided in the socket 72.

The eyelet 133 is electrically connected to the wiring pattern of the circuit substrate 151 via the lead wires 158. The shell 131 is also electrically connected to the wiring pattern of the circuit substrate 151 via the lead wires 158.

A rectifying circuit 155*a* that rectifies the supplied alternating current is provided in the lighting circuit 155. In the lighting circuit 155, after a current mirror circuit 155*b* amplifies the current rectified by the rectifying circuit 155*a*, a filter circuit 155*c* filters the current into a predetermined frequency. Furthermore, in the lighting circuit 155, a power-factor correction circuit 155*d* regulates the voltage of the current filtered by the filter circuit 155*c*, and a control circuit 155*e* controls the voltage at a predetermined level.

Based on the surrounding temperature detected by a PTC thermistor 155*f*, the control circuit 155*e* controls the voltage and outputs the current to a buck-boost converter 155*g*. The buck-boost converter 155*g* adjusts the voltage output by the control circuit 155*e* to a predetermined voltage.

The pair of lead wires 154 is connected to the buck-boost converter 155*g* via the wiring pattern provided on the circuit substrate 151. As described above, the lead wires 154 are electrically connected to the LED module 142. The LED chips 142*a* provided on the LED module 142 are lit by the current flowing through the lead wires 154.

The electronic components, such as resistors, electrolytic capacitors, and other electronic components, that form the components of the lighting circuit, i.e. the rectifying circuit 155*a*, the current mirror circuit 155*b*, the filter circuit 155*c*, the power-factor correction circuit 155*d*, the control circuit 155*e*, the PTC thermistor 155*f*, and the buck-boost converter 155*g*, are distributed between being mounted on, the front surface and on the back surface of the circuit substrate 151.

For example, the rectifying circuit 155*a* is mounted on a portion of the circuit substrate 151 within the case connector 122 located in the base 130, whereas the control circuit 155*e* is mounted on a portion of the circuit substrate 151 within the case body 121 located in the main housing 111. Furthermore, the power-factor correction circuit 155*d*, which includes an electrolytic capacitor, a relatively large electronic component, is mounted on one surface of a portion of the circuit substrate 151 in the case body 121 by the back surface of the module support 141 within the housing receptacle 112. The buck-boost converter 155*g*, which includes a coil, another relatively large electronic component, is mounted on the other surface.

The bulb-shaped LED lamp 100 with this structure is assembled as follows. First, the circuit substrate 151 is prepared by forming therein the lighting circuit 155 that has pre-mounted electronic components. One end of the lead wires 154 provided at one end of the circuit substrate 151 and one end of the lead wires 158 provided at the other end of the circuit substrate 151 are connected to the wiring pattern on the lighting circuit 155. The other ends of each pair of lead wires are not respectively connected to the wiring pattern of the LED module 142 or to the base 130.

The circuit substrate 151 in this state is attached within the case body 121 of the circuit case 120. At this point, the case body 121 and the case connector 122 are separated from each other. Therefore, the circuit substrate 151 can be attached within the case body 121 from the open end of the case body 121 by engaging the lateral edge of the circuit substrate 151 with the groove provided on the inner circumferential surface of the case body 121 and sliding the circuit substrate 151. The lead wires 154 are then drawn from the case body 121 through the through-holes 121*d* and 121*e* provided in the case body 121.

Upon attaching the circuit substrate 151 to the case body 121, the housing 110 is prepared. At this point, the main housing 111 and the housing receptacle 112 are separated from each other, and the opening 112*a* of the housing receptacle 112 is not yet covered by the globe 116. In this state, after inserting the case body 121 into the housing receptacle 112, the module support 141 is attached to the inside of the housing receptacle 112.

At this point, the lead wires 154 drawn from the case body 121 are passed through the through-holes 141*b* provided in the module support 141 and attached to the LED module 142 on the module support 141. Subsequently, the ends of the lead wires 154 are electrically connected to predetermined positions in the wiring pattern of the LED module 142. At this point, the globe 116 is attached to the module support 141. Note that the globe 116 may be attached to the module support 141 as a final step.

Next, the case connector 122 is engaged with the portion of the circuit substrate 151 projecting from the case body 121. The flange 122*a* of the case connector 122 is inserted into the open end of the case body 121, causing the flange 122*a* and the end face 111*a* of the housing 110 to come into contact. The case connector 122 is thus rotatably supported with respect to the housing 110. Furthermore, the lead wires 158 provided in the circuit substrate 151 protrude from the end of the case connector 122 after having been twisted together.

Next, the main housing 111 is engaged with the outside of the case body 121, which projects from the housing receptacle 112, and the outer circumferential surface of the case body 121 and the inner circumferential surface of the main housing 111 are joined together by, for example, being welded or bonded with adhesive.

Subsequently, the side face of the insulating ring 143 on which the guide groove 143*a* is provided is brought into contact with the end face 111*a* of the main housing 111. At this point, the guide pin 114 provided on the end face 111*a* of the main housing 111 is inserted into the guide groove 143*a*. In this state, the base 130 is inserted into the case connector 122 and rotated. The screw groove provided on the inner circumferential surface of the shell 131 in the base 130 is thus screwed onto the thread 122*b* provided on the outer circumferential surface of the case connector 122.

Further rotating the base 130 that is screwed onto the case connector 122 results in the case connector 122 being inserted into the base 130. As a result, the end face of the shell 131 in the base 130 presses the insulating ring 143 against the end face 111*a* of the main housing 111. At this point, the pair of projections 122*c* provided on the outer circumferential surface of the case connector 122 engage with the engaging grooves 143*b* provided in the insulating ring 143, so that the insulating ring 143 is prevented from rotating with respect to the case connector 122.

When this state has been reached, one of the lead wires 158 provided on the circuit substrate 151 is soldered to the eyelet 133 of the base 130, and the other lead wire 158 is soldered to the shell 131 of the base 130.

The lead wires 158 are twisted around each other so as not to be disconnected even if the circuit substrate 151 rotates 360° with respect to the base 130. This completes assembly of the bulb-shaped LED lamp 100 of the present invention.

In the assembled bulb-shaped LED lamp 100, the base 130 integrally attached to the case connector 122 of the circuit case 120. Moreover, the housing 110 is attached to the base 130 so as to be rotatable over a range not exceeding one rotation (360°) due to the insulating ring 143 not being rotatable with respect to the case connector 122. The case body 121 of the circuit case 120 is integrally attached to the housing 110, and the circuit substrate 151 is integrally attached to the case body 121. Furthermore, the circuit substrate 151 is rotatable with respect to the case connector 122, which is integrated with the base 130.

As in the mount 10 in the bulb-shaped lamp described above, on the outer circumferential surface of the housing receptacle 112 and the main housing 111 in the housing 110, an alumite layer (anodic oxide coating, alumite coating) that is, for example, 10 μm thick is formed by alumite treatment. The alumite layer improves heat dissipation characteristics.

Note that in this modification as well, instead of forming an alumite layer on the outer circumferential surface of the housing 110, heat dissipation characteristics may also be improved by applying a predetermined synthetic resin.

When mounting this bulb-shaped LED lamp 100 into the lighting fixture 70 for incandescent bulbs as shown in FIG. 10, a user inserts the bulb-shaped LED lamp 100 through the opening at the bottom of the fixture body 71, which is attached to the ceiling, while holding onto the housing 110. In accordance with the size of the opening, the bulb-shaped LED lamp 100 is inclined to be nearly perpendicular with respect to the axial direction of the socket 72. The base 130 of the bulb-shaped LED lamp 100 is then inserted into the socket 72.

The user then rotates the housing 110 in a predetermined direction in the fixture body 71 in order to screw the base 130 of the bulb-shaped LED lamp 100 into the socket 72. Rotation in the predetermined direction is hereinafter referred to as rotation in the normal direction. In this case, the user can rotate the housing 110 in the normal direction in a comparatively large space near the opening at the bottom of the fixture body 71.

Note that rotating the housing 110 with respect to the insulating ring 143 requires a slightly larger force than the friction between the insulating ring 143 and the end face 111*a* of the main housing 111.

At this point, if the guide pin 114 provided on the end face 111*a* of the main housing 111 is not in contact with the engaging portion 143*c* of the guide groove 143*a*, which would restrict rotation in the normal direction, then the housing 110 is rotated with respect to the insulating ring 143 until the guide pin 114 comes into contact with the engaging portion 143*c*.

The case body 121, which is integrated with the housing 110, rotates so that the circuit substrate 151, which is integrally attached within the case body 121, also rotates. However, since the circuit substrate 151 is rotatable with respect to the case connector 122, the case connector 122 does not rotate. The base 130, which is integrated with the case connector 122, therefore does not rotate; rather, the circuit substrate 151 rotates.

At this point, since the pair of lead wires 158 that are electrically connected to the circuit substrate 151 and the base 130 have been twisted together, the lead wires 158 are either further twisted together or partially untwisted. Furthermore, the housing 110 does not rotate 360° with respect to the case connector 122 due to the restricting member formed by the guide pin 114 and the guide groove 143*a*. Therefore, there is no risk of the lead wires 158 being disconnected or damaged.

Subsequently, when the guide pin 114 of the housing 110 comes into contact with the engaging portion 143*c* of the insulating ring 143, rotation of the housing 110 with respect to the insulating ring 143 and the case connector 122 is restricted. The user, however, needs to continue rotating the housing 110 in the normal direction in order to mount the base 130 into the socket 72. Therefore, the user continues to rotate the housing 110 in the normal direction.

As a result, the base 130 that has been screwed into the case connector 122 rotates integrally with the housing 110, so that the base 130 is screwed into the socket 72.

When the base 130 of the bulb-shaped LED lamp 100 is thus screwed into the socket 72, the user can confirm whether the LED module 142 is visible through the globe 116 from beneath the fixture body 71, the LED module 142 being attached to the module support 141, which in turn is integrated with the housing 110. If the entire LED module 142 cannot be seen through the globe 116, then the light-emitting direction of the LED module 142 does not face downwards. The housing 110 should therefore be rotated in the direction opposite the normal direction.

This rotation in the reverse direction also requires a force slightly larger than the friction between the insulating ring 143 and the end face 111*a* of the main housing 111.

By rotating the housing 110 in the reverse direction, the case body 121 which is integrated with the housing 110 also rotates in the same direction as the housing 110, i.e. the reverse direction. Once the LED module 142 becomes visible through the globe 116, the housing 110 is further rotated in the reverse direction so that the light-emitting direction of the LED module 142 points towards a desired region beneath the fixture body 71.

When the region illuminated by light from the LED module 142 corresponds to the desired region below the fixture body 71, the user stops rotating the housing 110 in the reverse direction.

At this point, the housing 110 is supported so as not to rotate with respect to the insulating ring 143 due to pressure from the insulating ring 143 acting on the end face 111*a* of the main housing 111. Accordingly, the case connector 122, which is prevented from rotating with respect to the insulating ring 143, and the base 130, which is screwed onto the case connector 122, are both supported so as not to rotate with respect to the housing 110.

With this structure for the bulb-shaped LED lamp 100 of the present embodiment, when mounting the base 130 into the socket 72 of the existing lighting fixture 70 for incandescent bulbs, it suffices to rotate the housing 110 within the fixture body 71 in the predetermined direction. Subsequently, in order to adjust the light-emitting direction of the LED module 142, it suffices to rotate the housing 110 in the reverse direction.

Accordingly, once the bulb-shaped LED lamp 100 is mounted into the socket 72 of the lighting fixture 70, it suffices for there to be space to rotate the housing 110 within the fixture body 71 in order to adjust the light-emitting direction of the LED module 142. As a result, it is not necessary to guarantee space within the fixture body 71 for adjusting the light-emitting direction of the LED module 142. The bulb-shaped LED lamp 100 can thus be enlarged until nearly coming into contact with the inner surface of the fixture body 71.

Thus increasing the size of the bulb-shaped LED lamp 100 allows for an increase in size of the circuit case 120 as well. In turn, this allows for an increase in the size of the electronic components of the lighting circuit 155. Furthermore, the circuit substrate 151 of the lighting circuit 155 housed in the circuit case 120 is provided along the axial direction and protrudes into a space by the back surface of the LED module 142, which is inclined with respect to the axial direction of the housing 110, the back surface being opposite the direction of illumination of light from the LED module 142. Therefore, the large electronic components forming the lighting circuit 155 can be positioned within this space.

As a result, the lighting circuit 155 can be formed to increase the amount of power provided to the LED module 142, allowing for high-power output by the LED module 142. The bulb-shaped lamp can thus be made compact while yielding high-power output. Furthermore, the electronic components need not be concentrated on the circuit substrate, which helps prevent the electronic components from becoming hot.

Even if the LED chips 142*a* in the LED module 142 become hot, the heat is radiated by being transferred to the housing 110, which has heat dissipation characteristics, via the module support 141. By including the main housing 111 and the housing receptacle 112, the housing 110 has a large surface area, and therefore efficiently radiates heat. The LED module 142 is thus effectively prevented from reaching a high temperature. Furthermore, forming an alumite layer or a predetermined synthetic resin layer on the outer circumferential surface of the housing 110 further improves the heat dissipation characteristics.

Modification to Embodiment 2

Figure 15:
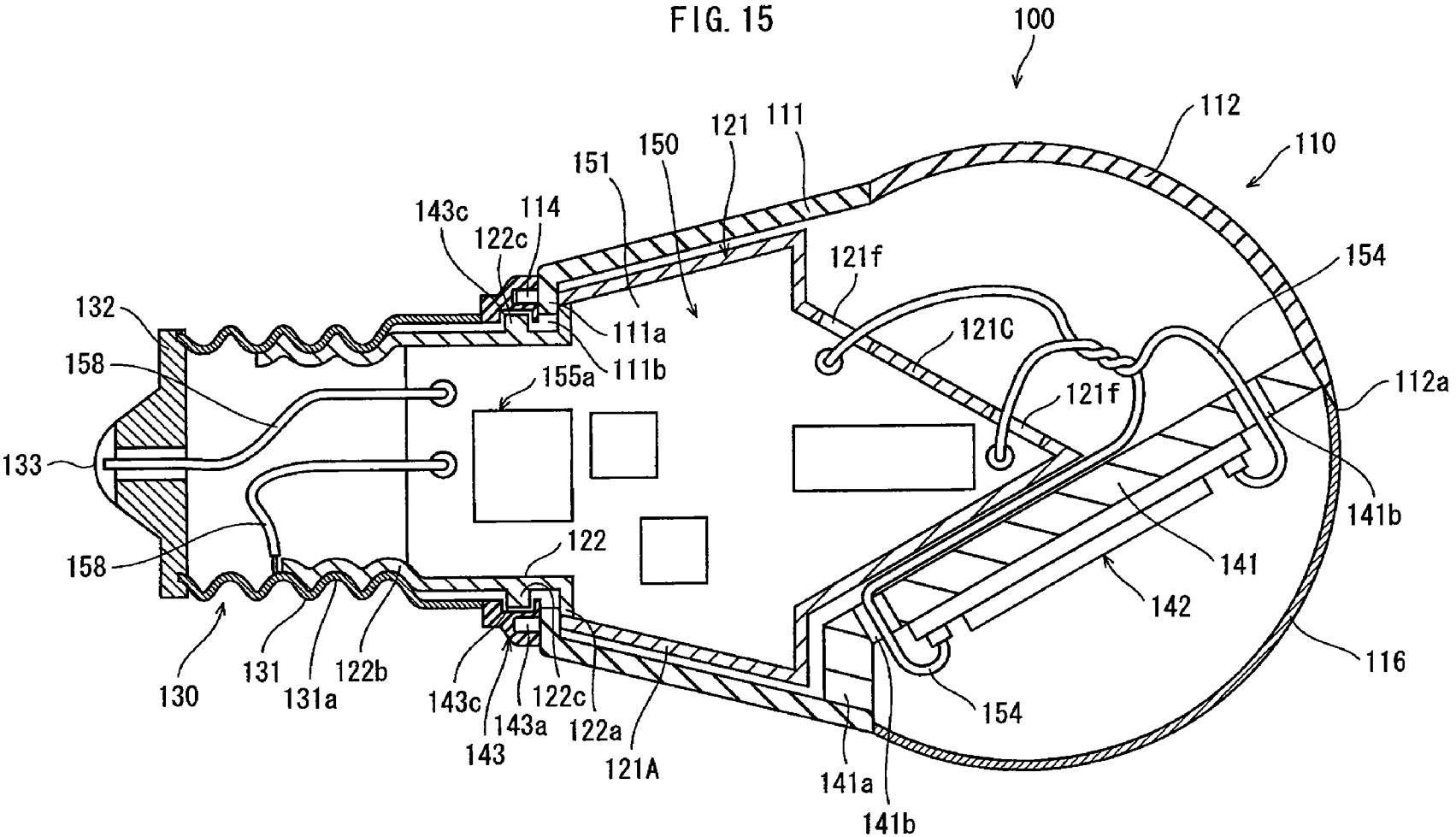
FIG. 15 is a lateral cross-section diagram of a bulb-shaped LED lamp according to a modification of Embodiment 2 of the present invention.

In Embodiment 2, the circuit substrate 151 is integrally attached to the case body 121, which is attached to the housing 110, and is rotatable with respect to the case connector 122 that is screwed onto the base 130. The circuit substrate 151 is not, however, limited to this structure. As shown in FIG. 15, a circuit substrate 151 may be attached integrally to a case connector 122 that is screwed onto a base 130 and may be rotatable with respect to a case body 121, so that the case body 121 and a housing 110 are rotatable with respect to each other.

In this case, the case body 121 is formed so that a module support 141, which rotates integrally with the housing 110, does not come into contact with the case body 121. Specifically, the case body 121 includes a bottom section 121A and a conical protruding section 121C. The bottom section 121A is in the shape of a circular truncated cone and is housed rotatably in a main housing 111, which is also in the shape of a circular truncated cone. The protruding section 121C is formed at the center of the larger diameter end face of the bottom section 121A and protrudes towards the back surface of the module support 141.

So as to be housed within the protruding section 121C, the end of the circuit substrate 151 protruding towards the module support 141 is triangular. Electronic components of an appropriate size are mounted on this triangular end.

Lead wires 154 connected to an LED module 142 are twisted together after passing through through-holes 141*b* provided in the module support 141. The lead wires 154 then further pass through a pair of through-holes 121*f* provided on the protruding section 121C of the case body 121. After passing through the through-holes 121*f*, the tips of the lead wires 154 are electrically connected to predetermined portions of a wiring pattern on the circuit substrate 151.

In this case as well, when mounting a bulb-shaped LED lamp 100 with this structure into the lighting fixture 70 for incandescent bulbs as shown in FIG. 10 by rotating the housing 110 in a predetermined direction, the housing 110 becomes integrated with a circuit case 120 before completing one rotation with respect to the circuit case 120. The circuit case 120 then rotates integrally with the base 130 so as to be mounted in the socket 72 of the lighting fixture 70. Subsequently, by rotating the housing 110 in the reverse direction, only the housing 110 rotates with respect to the circuit case 120, so that the globe 116 attached to the opening 112*a* of the housing 110 faces downwards in a predetermined direction.

Note that in this case, the lead wires 158 respectively connected to the shell 131 and the eyelet 133 of the base 130 need not be twisted together. It poses no particular problem, however, if the lead wires 158 are twisted together.

Embodiment 3

Figure 16:
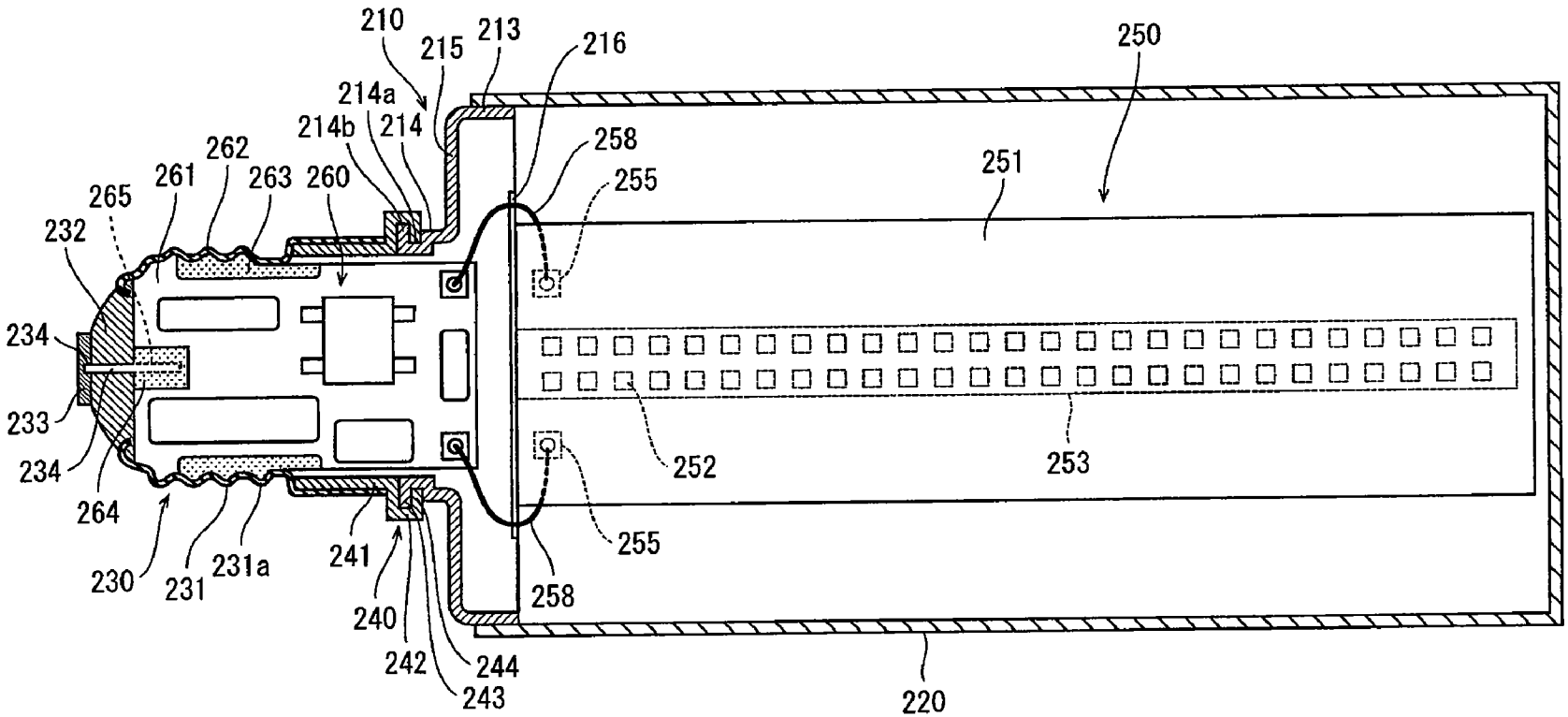
FIG. 16 is a lateral cross-section diagram of a bulb-shaped LED lamp according to Embodiment 3 of the present invention.
Figure 17:
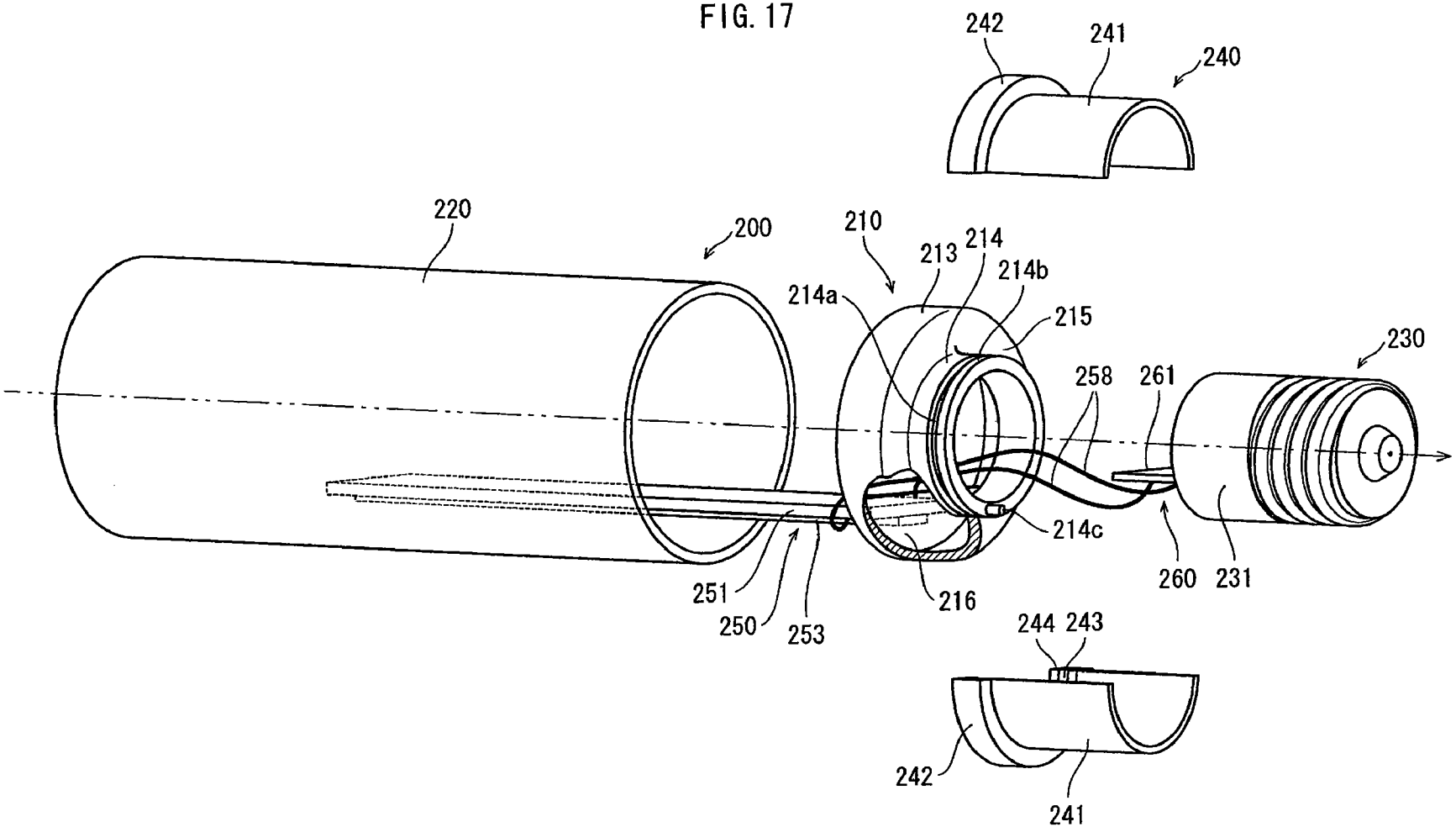
FIG. 17 is an exploded perspective view of the bulb-shaped LED lamp.

FIG. 16 is a lateral cross-section diagram of a bulb-shaped LED lamp 200 according to the present embodiment. FIG. 17 is an exploded perspective view of the bulb-shaped LED lamp 200.

The bulb-shaped LED lamp 200 of the present embodiment is provided with a base 230, a mount 210, an LED module 250, and an outer casing 220. The base 230 is attached to a lighting fixture similar to the lighting fixture 70 shown in FIG. 1. The mount 210 is attached to the base 230. The LED module 250 is supported by the mount 210 and is in the shape of a strip elongated in the direction of support by the mount 210. The outer casing 220 is light transmissive and is attached to the mount 210 so as to cover the LED module 250.

The base 230 includes a shell 231 in the shape of a circular cylinder. A lighting circuit unit 260 for lighting the LED module 250 is provided inside the shell 231. Accordingly, unlike the above embodiments, in the bulb-shaped LED lamp of the present embodiment no circuit unit case, circuit case, or the like is provided on the bulb-shaped LED lamp.

The mount 210 includes a mount body 213 in the shape of a circular cylinder, a mount bottom surface 215 covering one end face of the mount body 213 except for the center thereof, and a mount connector 214 in the shape of a circular cylinder that projects from around the center of the mount bottom surface 215 towards the base 230. These components are integrally formed with the same material. The mount body 213 is shorter in the axial direction than the mount body 13 shown in FIGS. 7 and 8.

One end of the outer casing 220 engages with the mount body 213 and is supported coaxially with the mount body 213 while extending from the mount body 213 in the direction opposite the base 230. The outer casing 220 is formed from a light transmissive material, such as glass, in the shape of a circular cylinder. The end face of the outer casing 220 opposite the base 230 is covered. One end of the outer casing 220 is engaged with the outer circumferential surface of the mount body 213 and is integrally attached to the mount body 213 with adhesive or the like.

Figure 18:
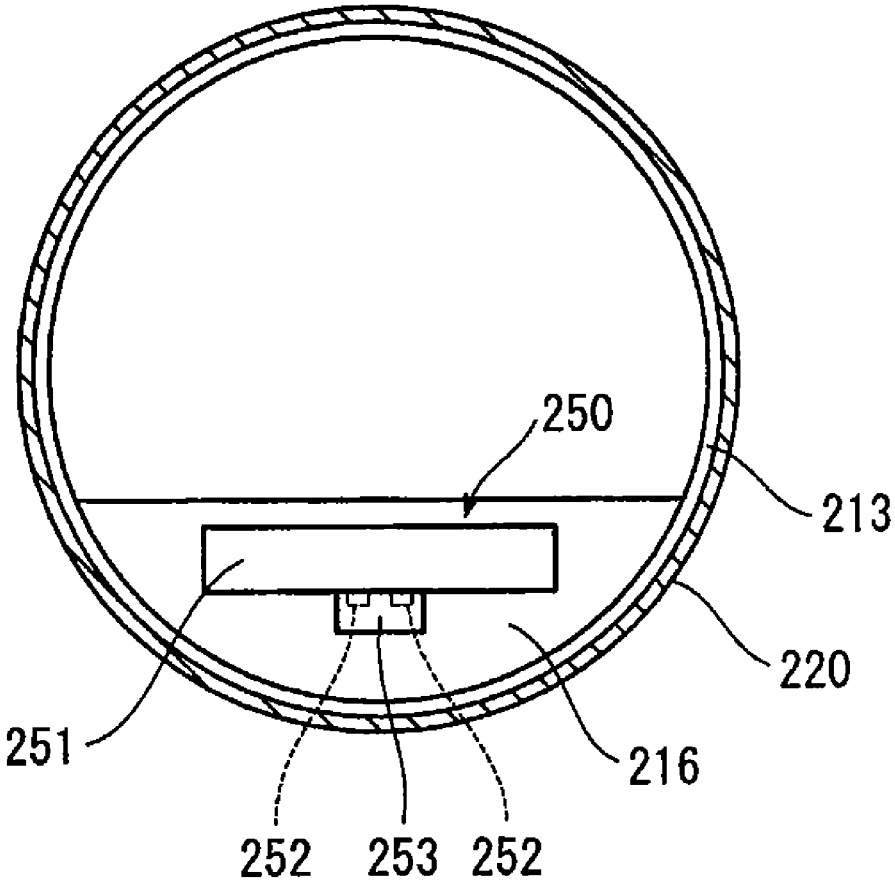
FIG. 18 is a schematic drawing of a lateral cross-section of an outer casing provided in the bulb-shaped LED lamp.

FIG. 18 is a lateral cross-section diagram of the structure of the outer casing 220 to illustrate the shape of the mount body 213. At the opposite end of the mount body 213 from the base 230, a support 216 is provided to support the LED module 250. The support 216 located inside the outer casing 220 is in the shape of a slice (i.e. semilunar) that abuts the inner circumferential surface of the mount body 213 so as to cover a portion of the side face of the mount body 213 at the end thereof opposite the base 230.

The elongated LED module 250 is supported with one end thereof in the direction of length abutting the end face of the support 216 opposite the base 230. Accordingly, the LED module 250 is positioned parallel to the central axis of the mount body 213 at a distance from the central axis.

As shown in FIG. 16, the LED module 250 is formed by a mounting substrate 251 that is elongated in one direction, a plurality of LED chips 252 mounted on one surface of the mounting substrate 251, and a phosphor-containing resin 253 that seals all of the LED chips 252. The mounting substrate 251 is formed, for example, by a non-light-transmissive alumina substrate of a predetermined thickness. One end face thereof abuts the support 216 of the mount body 213 and is attached to the support 216. The LED chips 252 are arranged in the direction of length of the mounting substrate 251, for example in two rows. Note that the LED chips 252 may be arranged on the mounting substrate 251 in one row or in three or more rows.

A predetermined wiring pattern (not shown in the figures) is provided on the mounting surface of the mounting substrate 251, and the LED chips 252 are electrically connected to the predetermined wiring pattern. At the end of the mounting substrate 251 by the mount 210, a pair of terminals 255 is provided on the surface of the mounting substrate 251 on which the LED chips 252 are mounted. The terminals 255 are for supplying current to the LED chips 252. Ends of a pair of lead wires 258 are connected to the corresponding terminals 255.

The phosphor-containing resin 253 is, for example, formed by dispersing phosphor particles in a translucent material such as silicone resin. The phosphor particles convert a portion of blue light emitted by the LED chips 252 into light of a longer wavelength than the blue light. The light of a longer wavelength, as converted by the phosphor particles, mixes with blue light whose wavelength is not converted by the phosphor particles, yielding white light. The white light is emitted to the outside of the phosphor-containing resin 253.

As shown in FIG. 18, the LED module 250 is supported on the support 216 of the mount 210 so that the phosphor-containing resin 253 faces the inner circumferential surface of the outer casing 220 located near the LED module 250. Accordingly, light that is emitted from the LED chips 252 and passes through the phosphor-containing resin 253 then passes through the circumferential surface of the outer casing 220 located near the LED module 250 and is emitted outside of the outer casing 220.

The mount connector 214, which protrudes from the mount bottom surface 215 of the mount 210 towards the base 230, is short in the axial direction. A mount-side groove 214*a* that opens outwards is formed along the entire outer circumference of the mount connector 214. The end of the mount connector 214 by the base 230 is a mount-side protrusion 214*b* that forms a side-wall of the mount-side groove 214*a*. This mount-side protrusion 214*b* has a constant length in the axial direction (i.e. thickness) around the entire perimeter thereof.

As shown in FIG. 17, a stopper 214*c* that protrudes towards the base 230 is provided on an end face of the mount-side protrusion 214*b* by the base 230. The stopper 214*c* is pin-shaped and is provided at any position along the circumference of the side face of the mount-side protrusion 214*b*.

As shown in FIG. 16, the mount connector 214 is connected to the base 230 by an insulating connector 240. As shown in FIG. 17, the insulating connector 240 includes a pair of half-cylinder members 241 that are insulating, elastic bodies formed as halves of a circular cylinder. The half-cylinder members 241 form a circular cylinder when placed adjacent to each other. As shown in FIG. 18, one end of the circular cylinder engages with the outer periphery of the mount connector 214, the remainder of the circular cylinder being inserted into the shell 231.

Figure 19C:
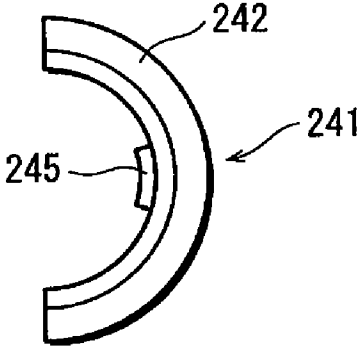
FIGS. 19B and 19C are lateral views of the half-cylinder member, respectively viewed from the mount and the base.
Figure 19A:
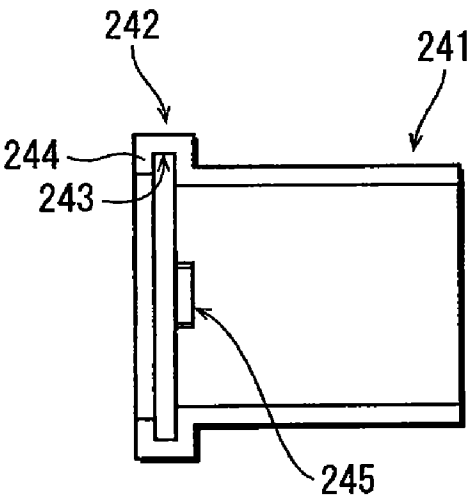
FIG. 19A is a front view of one of two half-cylinder members that form an insulating connector provided in the bulb-shaped LED lamp.
Figure 19B:
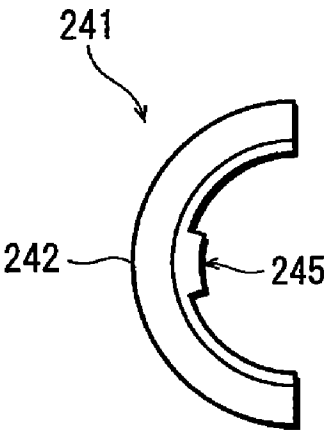

FIG. 19A is a front view of one half-cylinder member 241. FIGS. 19B and 19C are lateral views of the side of the half-cylinder member 241, respectively viewed from the mount 210 and the base 230. A flange 242 is formed on each half-cylinder member 241 at an edge thereof protruding from the shell 231. The flange 242 extends outwards in the diametrical direction of the shell 231.

Along the inner circumference of each flange 242, a base-side groove 243 is formed facing in a central direction. The base-side groove 243 provided on the half-cylinder members 241 is continuous around the entire circumference when the half-cylinder members 241 are placed adjacent to each other. The side of the flange 242 by the mount 210 forms a base-side protrusion 244 that constitutes the outer wall of the base-side groove 243.

Around the entire perimeter, the base-side protrusion 244 has a constant length (thickness) in the axial direction of the base 230. The base-side groove 243 is also a constant length (thickness) along the axial direction of the base 230. The thickness of the base-side groove 243 is slightly less than the thickness of the mount-side protrusion 214*b* provided on the mount connector 214 of the mount 210.

As shown in FIGS. 19A to 19C, an engaging projection 245 is provided on one of the half-cylinder members 241. The engaging projection 245 projects towards the central axis from a central region in the circumferential direction of the inner circumferential surface of the base-side groove 243 opposite the base-side protrusion 244. The engaging projection 245 has a predetermined length in the circumferential direction. The stopper 214*c* provided on the mount-side protrusion 214*b* of the mount 210 can come into contact with either side of the engaging projection 245 in the circumferential direction. No such engaging projection is provided on the other half-cylinder member 241.

In the insulating connector 240, the flange 242 of each half-cylinder member 241 engages with the mount connector 214 of the mount 210. The mount-side protrusion 214*b* provided on the mount connector 214 of the mount 210 engages with the base-side groove 243 in each half-cylinder member 241, and the base-side protrusion 244 provided on each half-cylinder member 241 engages with the mount-side groove 214*a* of the mount connector 214.

Note that the thickness of the mount-side protrusion 214*b* is slightly greater than the width of the base-side groove 243. Since the half-cylinder members 241 in which the base-side groove 243 is formed, however, are insulating, elastic bodies, the mount-side protrusion 214*b* is pressed into the base-side groove 243. As a result, the mount-side protrusion 214*b* is pressed against the base-side groove 243 and maintained without sliding due to friction between the mount-side protrusion 214*b* and the base-side groove 243.

The stopper 214*c* provided at the end face of the mount-side protrusion 214*b* enters further into the insulating connector 240 than the base-side groove 243.

In this state, when a rotational force (torque) applied to the mount-side protrusion 214*b* is larger than the force of friction between the mount-side protrusion 214*b* and the base-side groove 243, the mount-side protrusion 214*b* slides within the base-side groove 243.

By sliding the mount-side protrusion 214*b* in either circumferential direction within the base-side groove 243, the stopper 214*c* comes into contact with one side, in the circumferential direction, of the engaging projection 245 provided in one of the half-cylinder members 241.

As a result, the mount-side protrusion 214*b* is restricted from sliding further within the base-side groove 243. In this state, upon applying a rotational force to the mount-side protrusion 214*b* in the same direction, the engaging projection 245 with which the stopper 214*c* is in contact is pressed upon by the stopper 214*c* and rotates integrally with the stopper 214*c*. As a result, the mount-side protrusion 214*b* and the base-side groove 243 rotate integrally in the same direction.

The mount-side protrusion 214*b* can thus slide within the base-side groove 243 until coming into contact with the sides of the engaging projection 245 in the circumferential direction. Accordingly, the mount connector 214 of the mount 210 is rotatable in a slightly smaller range than 360° (approximately 350°) with respect to the insulating connector 240. The outer casing 220, which is integrated with the mount 210, can rotate over the same range with respect to the base 230.

Having engaged with the mount connector 214 of the mount 210, the insulating connector 240 is inserted into the shell 231 from the end of the insulating connector 240 opposite the flanges 242. The insulating connector 240 is attached integrally to the shell 231 by adhesive or the like.

As shown in FIG. 16, a thread 231*a* is provided on the circumferential surface of the shell 231, as in each of the previous embodiments, in order to mount the shell 231 in the socket of a lighting fixture. In the thread 231*a* provided on the circumferential surface of the shell 231, screw grooves are formed by alternating peaks and valleys along the inner circumferential surface and the outer circumferential surface of the shell 231.

An insulating connector 232 is provided at the end of the shell 231 opposite the mount 210. The insulating connector 232 is hemispherical, and an eyelet 233 is attached to the outer circumferential surface of the insulating connector 232. A power supply pin 234 is attached to the eyelet 233 along the axial direction of the shell 231. The power supply pin 234 extends from the eyelet 233 through the insulating connector 232 along the central axis of the insulating connector 232 to protrude into the shell 231.

The lighting circuit unit 260 provided inside the shell 231 includes a flat circuit substrate 261 elongated in the direction of the central axis of the shell 231. Electronic components forming the lighting circuit unit 260 are mounted on both sides of the circuit substrate 261.

The width along the entire circuit substrate 261, i.e. in the direction of width perpendicular to the direction of length, is approximately equal to the diameter of the thread 231*a* in the shell 231. A central line along the direction of length of the circuit substrate 261 is aligned with the central axis of the shell 231.

On either side of the circuit substrate 261, concavities and convexities 262 are formed corresponding to the peaks and valleys of the thread 231*a* provided in the shell 231. On the sides of the circuit substrate 261 on which the concavities and convexities 262 are formed, lateral conducting patterns 263 are formed. The lateral conducting patterns 263 are electrically and thermally conductive. The lateral conducting patterns 263 are formed from a metal, such as copper or aluminum, that has excellent electrical and thermal conductive properties. Each lateral conducting pattern 263 has concavities and convexities conforming to the concavities and convexities 262 of the circuit substrate 261.

With the sides of the circuit substrate 261 on which the lateral conducting patterns 263 are provided abutting the shell 231, the circuit substrate 261 is rotated around the central axis in the direction of length so that the concavities and convexities 262 engage with and are screwed into the thread 231*a* of the shell 231. The circuit substrate 261 is inserted into the shell 231 along the direction of length thereof by the concavities and convexities 262 being further rotated around the central axis after being screwed into the thread 231*a*. As a result, the end of the circuit substrate 261 that is inserted into the shell 231 abuts the insulating connector 232 provided in the shell 231.

The central portion of the end of the circuit substrate 261 inserted into the shell 231 is a conductive tip 264 that is electrically and thermally conductive. The conductive tip 264 is formed from a metal, such as copper or aluminum, that has excellent electrical and thermal conductive properties. A pin hole 265 is provided on the conductive tip 264. The power supply pin 234 that projects from the insulating connector 232 is inserted into the pin hole 265 to be electrically connected with the conductive tip 264.

The circuit substrate 261 traverses the insulating connector 240 to extend into the mount body 213 of the mount 210. The end of the circuit substrate 261 located in the mount body 213 is connected to ends of the pair of lead wires 258. As described above, the other ends of the lead wires 258 are connected to the terminals 255 of the LED module 250 that is supported by the support 216 of the mount body 213. The lead wires 258 are of sufficient length so as not to be disconnected if the mount 210 rotates 360° with respect to the base 230.

When mounting the bulb-shaped LED lamp 200 with this structure into the lighting fixture 70 for incandescent bulbs as shown in FIG. 1, the outer casing 220 is first rotated with respect to the base 230 in the opposite direction (hereinafter referred to as rotation in the reverse direction) as the direction of rotation to screw the base 230 into the socket 72 (hereinafter referred to as rotation in the normal direction). By applying torque to the outer casing 220 with respect to the base 230, the mount-side protrusion 214*b* provided on the mount connector 214 slides within the base-side groove 243 provided in the insulating connector 240.

By rotating the outer casing 220 in the normal direction with respect to the base 230, the stopper 214*c* provided in the insulating connector 240 contacts with the engaging projection 245 provided in the insulating connector 240, so that the outer casing 220 can no longer rotate in the normal direction with respect to the base 230.

In this state, the user inserts the bulb-shaped LED lamp 200 through the opening at the bottom of the fixture body 71, which is attached to the ceiling, while holding onto the outer casing 220. In accordance with the size of the opening, the bulb-shaped LED lamp 200 is inclined to be nearly perpendicular with respect to the axial direction of the socket 72. The base 230 of the bulb-shaped LED lamp 200 is then inserted into the socket 72.

The user then rotates the outer casing 220 in the normal direction in the fixture body 71 in order to screw the base 230 of the bulb-shaped LED lamp 200 into the socket 72. In this case, the user can rotate the outer casing 220 in the normal direction in a comparatively large space near the opening at the bottom of the fixture body 71. The mount 210, which is integrated with the outer casing 220, is thus rotated in the same normal direction.

The base 230 is integrated with the insulating connector 240 that is attached to the mount connector 214 of the mount 210. Therefore, when the mount 210, which is integrated with the outer casing 220, is rotated in the normal direction, the base 230 rotates without receiving nearly any force from the socket 72 and is thus screwed into the socket 72. Accordingly, no torque acts on the mount connector 214, and thus the mount-side protrusion 214*b* provided in the mount connector 214 does not slide in the base-side groove 243 provided in the insulating connector 240.

Upon being mounted this way into the socket 72, the base 230 of the bulb-shaped LED lamp 200 no longer rotates with respect to the socket 72, and the outer casing 220 is nearly horizontal. Subsequently, the user can observe the LED module 250 attached to the mount 210 through the light-transmissive outer casing 220 from beneath the fixture body 71 to confirm the position of the phosphor-containing resin 253 provided on the LED module 250. The user then further rotates the outer casing 220 in the normal direction so that the phosphor-containing resin 253 is located towards the bottom of the horizontal outer casing 220.

At this point, the stopper 214*c* provided on the end face of the mount-side protrusion 214*b* is in contact with the engaging projection 245 of the insulating connector 240. The base 230 is mounted into the socket 72 and cannot be rotated in the normal direction with respect to the socket 72. Therefore, rotating the outer casing 220 in the normal direction applies torque to the mount 210, which is integrated with the outer casing 220, for rotation in the normal direction with respect to the insulating connector 240 attached to the base 230. As a result, the mount-side protrusion 214*b* provided on the mount connector 214 slides in the normal direction within the base-side groove 243 provided in the insulating connector 240.

Accordingly, the mount 210, which is integrated with the outer casing 220, rotates in the normal direction with respect to the base 230, which is attached to the socket 72. The LED module 250, which is attached to the mount 210, rotates along with the outer casing 220. Since the LED module 250 is provided eccentrically with respect to the outer casing 220, the LED module 250 revolves around the central axis of the outer casing 220. The phosphor-containing resin 253 on the LED module 250 can thus be positioned towards the bottom of the outer casing 220. As a result, the phosphor-containing resin 253 faces downwards.

At this stage, rotation of the outer casing 220 in the normal direction is complete. Since the mount-side protrusion 214*b* provided in the mount connector 214 is pressed into the base-side groove 243 provided in the insulating connector 240, there is no risk at this point of the outer casing 220 rotating with respect to the base 230. Therefore, the LED module 250 is maintained at a predetermined position towards the bottom of the outer casing 220.

In the bulb-shaped LED lamp 200 mounted into the lighting fixture 70, light emitted from the LED chips 252 of the LED module 250 passes through the outer casing 220 to shine on a region below the bulb-shaped LED lamp 200. Since the LED chips 252 are provided in rows along the axial direction of the outer casing 220, the region below the bulb-shaped LED lamp 200 is illuminated uniformly and over a large range in the axial direction of the outer casing 220.

Figure 20:
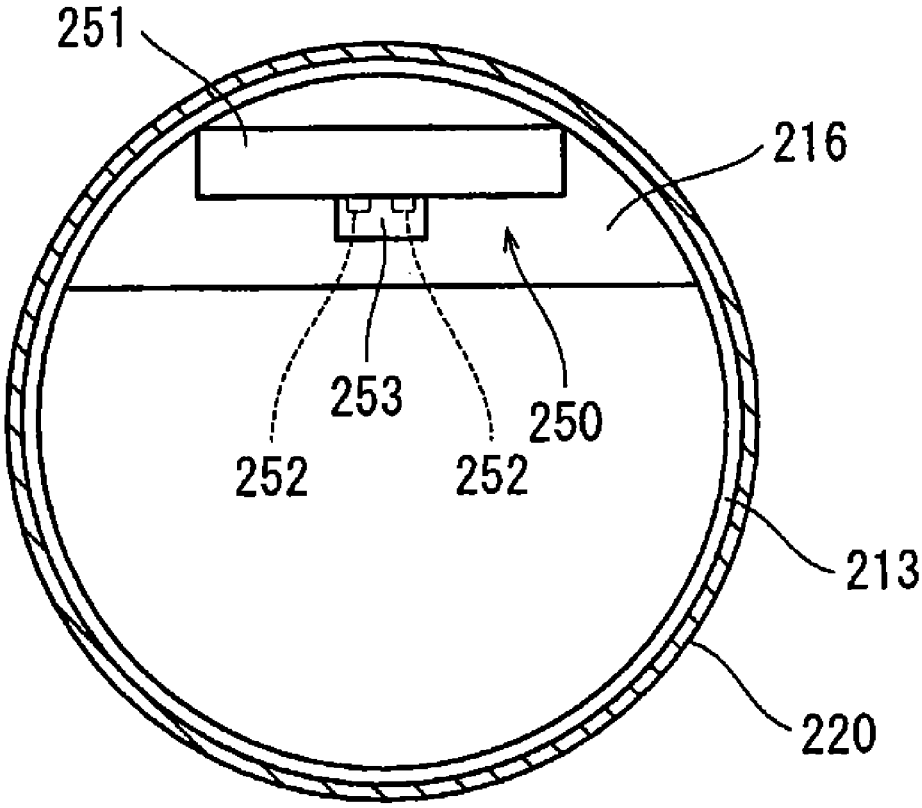
FIG. 20 is a schematic drawing of a lateral cross-section of an outer casing provided in a modification of the bulb-shaped LED lamp in the present embodiment.

Note that, as shown in FIG. 20, the LED module 250 in the bulb-shaped LED lamp 200 of the present embodiment may be attached to the support 216 of the mount 210 so that the back surface of the mounting substrate 251, opposite the surface on which the LED chips 252 are mounted, faces the inner circumferential surface of the outer casing 220 located near the LED module 250. In this case, the LED module 250 is adjusted with respect to the lighting fixture so as to be located towards the top of the outer casing 220. The light emitted from the LED chips 252 of the LED module 250 thus shines downwards from the lighting fixture.

Figure 21A:
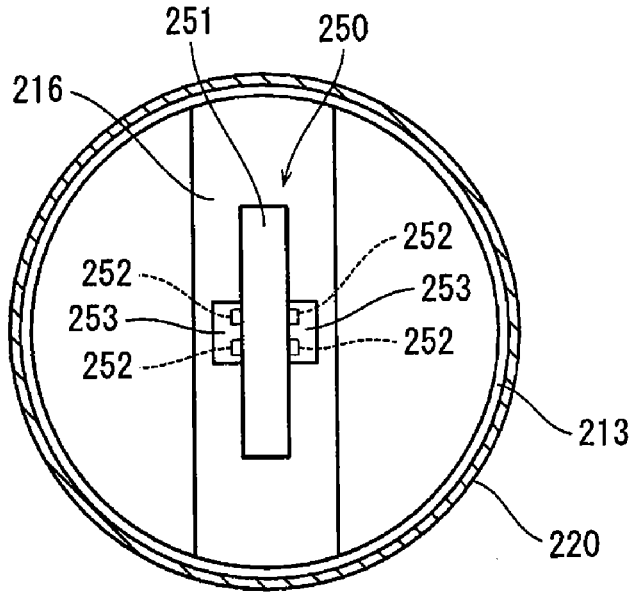
FIGS. 21A and 21B are schematic drawings of a lateral cross-section of an outer casing provided in another modification of the bulb-shaped LED lamp.

The bulb-shaped LED lamp 200 of the present embodiment may be structured to emit light from nearly the entire circumference of the outer casing 220, as shown in FIG. 21A. In this case, LED chips 252 are mounted on both sides of the mounting substrate 251 of the LED module 250. The LED chips 252 mounted on either side of the mounting substrate 251 are covered by the phosphor-containing resin 253.

Furthermore, the support 216 of the mount 210, to which the LED module 250 is attached, is formed in the central region of the mount body 213 and is elongated in the diametrical direction thereof. The support 216 is disposed between opposing locations on the inner circumferential surface of the mount body 213, spanning the central axis. The LED module 250 is supported by the support 216 so that the central axis in the direction of length of the mounting substrate 251 is aligned with the central axis of the outer casing 220.

In this bulb-shaped LED lamp 200, the LED chips 252 are mounted on both sides of the mounting substrate 251 in the LED module 250 provided within the light-transmissive outer casing 220. Therefore, light is emitted over a large range in almost all directions from the central axis of the outer casing 220.

Accordingly, when the base 230 is mounted into the socket 72 of the fixture body 71, there is no particular need to adjust the light-emitting direction of the LED module 250. Since the light-emitting direction can, however, be adjusted by rotating the outer casing 220, the user can change the light-emitting direction in accordance, for example, with personal preferences.

Note that since with this bulb-shaped LED lamp 200, since the light-emitting direction of the LED module 250 need not be adjusted, the base 230 and the mount 210 need not be rotatable and may be integrally attached to each other.

Figure 21B:
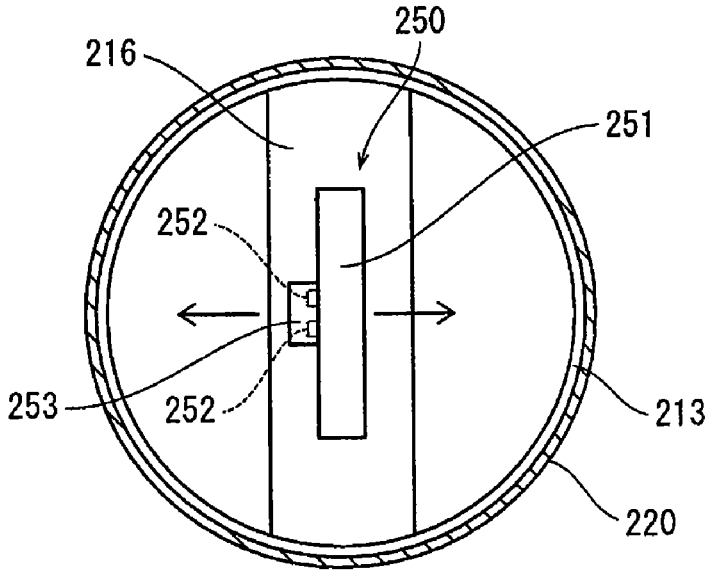

Furthermore, LED chips need not be mounted on both sides of the mounting substrate 251. As shown in FIG. 21B, a structure may be adopted in which the mounting substrate 251 is light-transmissive, and the LED chips 252 are mounted on only one side of the mounting substrate 251 and covered with the phosphor-containing resin 253. The mounting substrate 251 is made light transmissive by being formed, for example, from an alumina substrate with a thickness of 0.8 mm.

With this structure for the LED module 250 provided in the light-transmissive outer casing 220, the light emitted from the LED chips 252 towards the mounting substrate 251 passes through the mounting substrate 251, since the mounting substrate 251 on which the LED chips 252 are provided is light transmissive. The light that passes through the mounting substrate 251 then passes through the light-transmissive outer casing 220 to be emitted externally. Therefore, with this structure as well, light is emitted over a large range in almost all directions from the central axis of the outer casing 220.

INDUSTRIAL APPLICABILITY

The present invention is useful in bulb-shaped LED lamps that use semiconductor light-emitting devices as a light source and serve as a substitute for existing compact light bulbs, such as mini krypton bulbs.

REFERENCE SIGNS LIST

10 mount
11 mount body
12 mount bottom section
12*a* through-hole
12*b* mount bottom surface
12*c* engaging portion
20 circuit unit case
21 case body
22 connector
24 stopper ring
24*a* stopper
56*a* circuit substrate
30 base
31 shell
35 twisted wires
40 support
41 support body
42 support base
43 insulating member
51 LED module
56 lighting circuit unit
110 housing
111 main housing
112 housing receptacle
112*a* opening
114 guide pin
120 circuit case
121 case body
122 case connector
122*b* thread
130 base
131 shell
133 eyelet
141 module support
142 LED module
143 insulating ring
143*a* guide groove
150 lighting circuit unit
151 circuit substrate
154 lead wire
158 lead wire
210 mount
213 mount body
216 support

214 mount connector
214*a* mount-side groove
214*b* mount-side protrusion
214*c* stopper
215 mount bottom surface
240 insulating connector
241 half-cylinder member
242 flange
243 base-side groove
245 engaging projection
230 base
231 shell
231*a* thread
232 insulating connector
234 power supply pin
250 LED module
260 lighting circuit unit
261 circuit substrate
262 concavities and convexities
264 conductive tip

The invention claimed is:

1. A bulb-shaped lamp comprising:
a base to be inserted into a socket of a lighting fixture;
a mount supported by the base so as to be rotatable around a central axis of the base; and
a light-emitting module including a semiconductor light-emitting device and attached to an end or an outer surface of the mount, so that a direction of light emission from the semiconductor light-emitting device is inclined or perpendicular with respect to the central axis of the base.

2. The bulb-shaped lamp of claim 1, further comprising:
a lighting circuit unit configured to light the semiconductor light-emitting device of the light-emitting module, wherein
the mount is hollow, and
the lighting circuit unit is provided inside the mount.

3. The bulb-shaped lamp of claim 2, further comprising:
a case housing the lighting circuit unit, wherein
a portion of the case is provided inside the mount.

4. The bulb-shaped lamp of claim 3, further comprising
a connector in the case, the base being attached to a portion of the connector projecting outwards from the mount.

5. The bulb-shaped lamp of claim 4, further comprising
a restricting member configured to restrict the mount from exceeding one rotation with respect to the base.

6. The bulb-shaped lamp of claim 5, wherein
the restricting member includes a ring member attached to the case and engaged with the connector in the case, and
the ring member includes an engaging portion at a location in a circumferential direction along the ring member, the mount includes an engaging portion at a location in a circumferential direction along a portion of the mount by the connector, and the engaging portions engage with each other by the mount and the case rotating relative to each other.

7. The bulb-shaped lamp of claim 2, wherein
the lighting circuit unit is electrically connected to the base by electrical wiring and is integrally attached to the mount, and
the electrical wiring is rotatable upon rotation of the mount.

8. The bulb-shaped lamp of claim 7, wherein
the mount and the support have high thermal conductivity and are in contact with each other.

9. The bulb-shaped lamp of claim 8, wherein
the mount and the support are formed from aluminum.

10. The bulb-shaped lamp of claim 1, further comprising
a support at an opposite end of the mount from the base, the support being rotatable integrally with the mount within the opposite end, wherein
the light-emitting module is attached to the support so that the direction of light emission from the semiconductor light-emitting device is inclined at a predetermined angle with respect to the central axis of the base.

11. The bulb-shaped lamp of claim 2, wherein
the light-emitting module is attached to the outer surface of the mount.

12. The bulb-shaped lamp of claim 11, wherein
the light-emitting module includes an elongated mounting substrate and a plurality of semiconductor light-emitting devices mounted on one surface of the mounting substrate along a direction of length thereof.

13. The bulb-shaped lamp of claim 11, wherein
the lighting circuit unit is electrically connected to the base and is integrally attached to the mount, and
the lighting circuit unit and the semiconductor light-emitting device of the light-emitting module are electrically connected by a rotary contact.

14. The bulb-shaped lamp of claim 1, further comprising
a light-transmitting globe at an opposite end of the mount from the base, the globe covering the light-emitting module.

15. The bulb-shaped lamp of claim 14, wherein
the globe includes a reflecting member that reflects light from the light-emitting module towards the direction of light emission.

16. A bulb-shaped lamp comprising:
a base to be inserted into a socket of a lighting fixture;
a housing attached to the base;
a light-emitting module including a semiconductor light-emitting device and provided in the housing so that a direction of light emission from the semiconductor light-emitting device is inclined with respect to the central axis of the base;
a lighting circuit electrically connected to the light-emitting module and to the base; and
a circuit substrate housed inside the housing, the lighting circuit being mounted on the circuit substrate, wherein
the circuit substrate is provided along a central axis of the base, and an end portion of the circuit substrate farther from the base is located in a space within the housing on an opposite side of the light-emitting module as the direction of light emission.

17. The bulb-shaped lamp of claim 16, wherein
an edge of the end portion of the circuit substrate farther from the base is near the light-emitting module, and an opposite end portion of the circuit substrate is housed inside the base.

18. The bulb-shaped lamp of claim 16, wherein
the housing has heat dissipation characteristics, conducts heat from the light-emitting module, and is insulated from the base.

19. The bulb-shaped lamp of claim 16, wherein
the circuit substrate is rotatable with respect to one of the housing and the base and is formed integrally with the other of the housing and the base.

20. The bulb-shaped lamp of claim 19, further comprising
a restricting member configured to restrict the housing from exceeding one rotation with respect to the base.

21. The bulb-shaped lamp of claim 20, wherein
the restricting member includes:
an insulating ring that is pressed against the housing by the base and includes an annular guide groove that is discontinuous in a circumferential direction at one location facing the housing, and a guide pin attached to the housing so as to engage slidably with the guide groove in the insulating ring.

22. The bulb-shaped lamp of claim 16, further comprising a circuit case housing the lighting circuit unit, wherein the circuit case extends from a position inside the housing to a position inside the base.

23. The bulb-shaped lamp of claim 22, wherein the circuit case includes:

a case body provided inside the housing, and a case connector rotatable with respect to the case body, a portion of the case connector protruding from the housing and integrally attached within the base.

24. The bulb-shaped lamp of claim 23, wherein the case body is integrally attached to the housing, and the circuit substrate is integrally attached to the case body and rotatable with respect to the case connector.

25. The bulb-shaped lamp of claim 24, wherein the circuit substrate is electrically connected to the base by a pair of electrical wires, and the pair of electrical wires are twisted around each other to allow the circuit substrate and the base to perform at least one rotation.

26. The bulb-shaped lamp of claim 23, wherein the case body is rotatable with respect to the housing, and the circuit substrate is integrally attached to the case connector and rotatable with respect to the case body.

27. The bulb-shaped lamp of claim 26, wherein the circuit substrate is electrically connected to the light-emitting module by a pair of electrical wires, and the pair of electrical wires are twisted around each other to allow the circuit substrate and the light-emitting module to perform at least one rotation.

28. The bulb-shaped lamp of claim 16, further including a thermally conductive module support attached to the housing in a thermally conductive state, the light-emitting module being mounted on the module support in the space within the housing so as to face an opening.

29. A bulb-shaped lamp comprising:

a base to be inserted into a socket of a lighting fixture;

a mount connected to the base so as to rotate integrally with the base; and a light-emitting module including an elongated mounting substrate and a plurality of semiconductor light-emitting devices mounted on the mounting substrate along a direction of length thereof, wherein the mounting substrate is supported by an end of the mount so as to extend away from the base along a central axis of the base, and the mount is rotatable with respect to the base.

30. The bulb-shaped lamp of claim 29, wherein the mounting substrate of the light-emitting module is displaced from a central axis of the outer casing.

31. The bulb-shaped lamp of claim 29, wherein the mounting substrate of the light-emitting module is light transmissive and is provided along a central axis of the outer casing.

32. The bulb-shaped lamp of claim 29, wherein the plurality of semiconductor light-emitting devices are mounted on both sides of the mounting substrate along the direction of length thereof, and the mounting substrate is provided along a central axis of the outer casing.

* * * * *